US009445649B2

(12) United States Patent
Huffa et al.

(10) Patent No.: US 9,445,649 B2
(45) Date of Patent: Sep. 20, 2016

(54) METHOD OF LASTING AN ARTICLE OF FOOTWEAR

(71) Applicant: NIKE, Inc., Beaverton, OR (US)

(72) Inventors: Bruce Huffa, Encino, CA (US); Bryan N. Farris, North Plains, OR (US)

(73) Assignee: NIKE, Inc., Beaverton, OR (US)

( * ) Notice: Subject to any disclaimer, the term of this patent is extended or adjusted under 35 U.S.C. 154(b) by 298 days.

(21) Appl. No.: 14/198,625

(22) Filed: Mar. 6, 2014

(65) Prior Publication Data

US 2014/0245546 A1 Sep. 4, 2014

Related U.S. Application Data

(62) Division of application No. 14/066,754, filed on Oct. 30, 2013, which is a division of application No. 12/848,352, filed on Aug. 2, 2010, now Pat. No. 8,595,878.

(51) Int. Cl.

| | |
|---|---|
| ***A43B 9/00*** | (2006.01) |
| ***A43D 3/02*** | (2006.01) |
| ***A43B 9/12*** | (2006.01) |
| ***A43B 9/02*** | (2006.01) |
| ***A43B 13/14*** | (2006.01) |
| ***A43B 13/38*** | (2006.01) |
| ***A43B 23/02*** | (2006.01) |
| ***A43D 3/00*** | (2006.01) |

(Continued)

(52) U.S. Cl.

CPC . *A43D 3/02* (2013.01); *A43B 1/04* (2013.01); *A43B 9/00* (2013.01); *A43B 9/02* (2013.01); *A43B 9/12* (2013.01); *A43B 13/14* (2013.01); *A43B 13/38* (2013.01); *A43B 23/025* (2013.01); *A43D 3/00* (2013.01); *D04B 1/22* (2013.01); *D10B 2501/043* (2013.01)

(58) Field of Classification Search

CPC ..... A43B 9/02; A43B 9/00; A43B 9/12; A43B 9/125; A43B 13/14

USPC ..... 36/45; 23/142 C, 142 F, 145

See application file for complete search history.

(56) References Cited

U.S. PATENT DOCUMENTS

| | | |
|---|---|---|
| RE3,602 E | 8/1869 | Johnson |
| 104,828 A | 6/1870 | Chambers |

(Continued)

FOREIGN PATENT DOCUMENTS

| | | |
|---|---|---|
| CH | 116795 | 12/1926 |
| CN | 101583294 A | 11/2009 |

(Continued)

OTHER PUBLICATIONS

Chinese Office Action issued May 25, 2015 in Chinese Patent Application No. 201180047869.6.

(Continued)

*Primary Examiner* — Ted Kavanaugh

(74) *Attorney, Agent, or Firm* — Brinks Gilson & Lione

(57) ABSTRACT

A method of manufacturing an article of footwear may include assembling at least a portion of an upper of the article of footwear, the upper having a lower perimeter edge. A knitted component forming a portion of the upper includes at least one strand formed with the knitted component. The strand passes through opposite sides of the upper along the lower perimeter edge. The strand is tensioned, and a sole structure of the article of footwear is joined to the upper.

7 Claims, 25 Drawing Sheets

(51) Int. Cl.

| | |
|---|---|
| ***A43B 1/04*** | (2006.01) |
| ***D04B 1/22*** | (2006.01) |

(56) References Cited

U.S. PATENT DOCUMENTS

| | | | | |
|---|---|---|---|---|
| 601,192 | A | | 3/1898 | Woodside |
| 888,476 | A | | 5/1908 | Davis |
| 1,003,463 | A | | 9/1911 | Jackson |
| 1,051,955 | A | | 2/1913 | Heilbrunn et al. |
| 1,124,184 | A | | 1/1915 | Straub |
| 1,215,198 | A | | 2/1917 | Rothstein |
| 1,217,463 | A | | 2/1917 | Krieger |
| 1,237,549 | A | | 8/1917 | Perri |
| 1,469,222 | A | | 10/1923 | La Chapelle |
| 1,597,934 | A | | 8/1926 | Stimpson |
| 1,714,271 | A | * | 5/1929 | Kelly ..... A43B 9/02 12/142 B |
| 1,888,172 | A | | 11/1932 | Joha |
| 1,902,780 | A | | 3/1933 | Holden et al. |
| 1,910,251 | A | | 5/1933 | Joha |
| 2,001,293 | A | | 5/1935 | Wilson |
| 2,047,724 | A | | 7/1936 | Zuckerman |
| 2,067,845 | A | | 1/1937 | Casanova |
| 2,147,197 | A | | 2/1939 | Glidden |
| 2,314,098 | A | | 3/1943 | McDonald |
| 2,330,199 | A | | 9/1943 | Basch |
| 2,343,390 | A | | 3/1944 | Ushakoff |
| 2,400,692 | A | | 5/1946 | Herbert |
| 2,440,393 | A | | 4/1948 | Clark |
| 2,569,764 | A | | 10/1951 | Jonas |
| 2,586,045 | A | | 2/1952 | Hoza |
| 2,608,078 | A | | 8/1952 | Anderson |
| 2,641,004 | A | | 6/1953 | Whiting et al. |
| 2,675,631 | A | | 4/1954 | Doughty |
| 2,994,322 | A | | 8/1961 | Cullen et al. |
| 3,583,081 | A | | 6/1971 | Hayashi |
| 3,694,940 | A | | 10/1972 | Stohr |
| 3,704,474 | A | | 12/1972 | Winkler |
| 3,739,502 | A | | 6/1973 | Auberry |
| 3,766,566 | A | | 10/1973 | Tadokoro |
| 3,778,856 | A | | 12/1973 | Chriestie et al. |
| 3,952,427 | A | | 4/1976 | Von den Benken et al. |
| 3,972,086 | A | | 8/1976 | Belli et al. |
| 4,027,402 | A | | 6/1977 | Liu et al. |
| 4,031,586 | A | | 6/1977 | Von Den Benken et al. |
| 4,211,806 | A | | 7/1980 | Civardi et al. |
| 4,232,458 | A | | 11/1980 | Bartels |
| 4,255,949 | A | | 3/1981 | Thorneburg |
| 4,258,480 | A | | 3/1981 | Famolare, Jr. |
| 4,317,292 | A | | 3/1982 | Melton |
| 4,373,361 | A | | 2/1983 | Thorneburg |
| 4,447,967 | A | | 5/1984 | Zaino |
| 4,465,448 | A | | 8/1984 | Aldridge |
| 4,607,439 | A | | 8/1986 | Sogabe |
| 4,737,396 | A | | 4/1988 | Kamat |
| 4,750,339 | A | | 6/1988 | Simpson et al. |
| 4,756,098 | A | | 7/1988 | Boggia |
| 4,785,558 | A | | 11/1988 | Shiomura |
| 4,813,158 | A | | 3/1989 | Brown |
| 5,031,423 | A | | 7/1991 | Ikenaga |
| 5,095,720 | A | | 3/1992 | Tibbals, Jr. |
| 5,117,567 | A | | 6/1992 | Berger |
| 5,152,025 | A | | 10/1992 | Hirmas |
| 5,192,601 | A | | 3/1993 | Neisler |
| 5,345,638 | A | | 9/1994 | Nishida |
| 5,353,524 | A | | 10/1994 | Brier |
| 5,371,957 | A | | 12/1994 | Gaudio |
| 5,461,884 | A | | 10/1995 | McCartney et al. |
| 5,511,323 | A | | 4/1996 | Dahlgren |
| 5,572,860 | A | | 11/1996 | Mitsumoto et al. |
| 5,575,090 | A | | 11/1996 | Condini |
| 5,623,840 | A | | 4/1997 | Roell |
| 5,729,918 | A | | 3/1998 | Smets |
| 5,735,145 | A | | 4/1998 | Pernick |
| 5,746,013 | A | | 5/1998 | Fay, Sr. |
| 5,765,296 | A | | 6/1998 | Ludemann et al. |
| 5,884,419 | A | | 3/1999 | Davidowitz et al. |
| 5,996,189 | A | | 12/1999 | Wang |
| 6,029,376 | A | | 2/2000 | Cass |
| 6,032,387 | A | | 3/2000 | Johnson |
| 6,052,921 | A | | 4/2000 | Oreck |
| 6,088,936 | A | | 7/2000 | Bahl |
| 6,151,802 | A | | 11/2000 | Reynolds |
| 6,170,175 | B1 | | 1/2001 | Funk |
| 6,308,438 | B1 | | 10/2001 | Throneburg et al. |
| 6,333,105 | B1 | | 12/2001 | Tanaka et al. |
| 6,401,364 | B1 | | 6/2002 | Burt |
| 6,558,784 | B1 | | 5/2003 | Norton et al. |
| 6,588,237 | B2 | | 7/2003 | Cole et al. |
| 6,754,983 | B2 | | 6/2004 | Hatfield et al. |
| 6,910,288 | B2 | | 6/2005 | Dua |
| 6,922,917 | B2 | | 8/2005 | Kerns et al. |
| 6,931,762 | B1 | | 8/2005 | Dua |
| D517,297 | S | | 3/2006 | Jones et al. |
| 7,051,460 | B2 | | 5/2006 | Orei et al. |
| 7,056,402 | B2 | | 6/2006 | Koerwien et al. |
| 7,347,011 | B2 | | 3/2008 | Dua et al. |
| 7,441,348 | B1 | | 10/2008 | Dawson |
| 7,543,397 | B2 | | 6/2009 | Kilgore et al. |
| 7,568,298 | B2 | | 8/2009 | Kerns |
| 7,682,219 | B2 | | 3/2010 | Falla |
| 8,490,299 | B2 | | 7/2013 | Dua et al. |
| 8,595,878 | B2 | | 12/2013 | Huffa et al. |
| 2002/0078599 | A1 | | 6/2002 | Delgorgue et al. |
| 2002/0148258 | A1 | | 10/2002 | Cole et al. |
| 2003/0126762 | A1 | | 7/2003 | Tseng |
| 2003/0191427 | A1 | | 10/2003 | Jay et al. |
| 2004/0118018 | A1 | | 6/2004 | Dua |
| 2004/0181972 | A1 | | 9/2004 | Csorba |
| 2005/0050769 | A1 | | 3/2005 | Haimerl et al. |
| 2005/0115284 | A1 | | 6/2005 | Dua |
| 2005/0193592 | A1 | | 9/2005 | Dua et al. |
| 2005/0273988 | A1 | | 12/2005 | Christy |
| 2005/0284000 | A1 | | 12/2005 | Kerns |
| 2006/0059715 | A1 | | 3/2006 | Aveni |
| 2006/0162187 | A1 | | 7/2006 | Byrnes et al. |
| 2007/0022627 | A1 | | 2/2007 | Sokolowski et al. |
| 2007/0180730 | A1 | | 8/2007 | Greene et al. |
| 2007/0294920 | A1 | | 12/2007 | Baychar |
| 2008/0017294 | A1 | | 1/2008 | Bailey et al. |
| 2008/0078102 | A1 | | 4/2008 | Kilgore et al. |
| 2008/0110048 | A1 | | 5/2008 | Dua et al. |
| 2008/0110049 | A1 | | 5/2008 | Sokolowski et al. |
| 2008/0189830 | A1 | | 8/2008 | Egglesfield |
| 2008/0313939 | A1 | | 12/2008 | Ardill |
| 2009/0068908 | A1 | | 3/2009 | Hinchcliff |
| 2010/0051132 | A1 | | 3/2010 | Glenn |
| 2010/0154256 | A1 | | 6/2010 | Dua |
| 2010/0170651 | A1 | | 7/2010 | Scherb et al. |
| 2011/0030244 | A1 | | 2/2011 | Motawi et al. |
| 2011/0078921 | A1 | | 4/2011 | Greene et al. |
| 2012/0023686 | A1 | | 2/2012 | Huffa et al. |
| 2012/0255201 | A1 | | 10/2012 | Little |
| 2014/0123409 | A1 | | 5/2014 | Huffa et al. |

FOREIGN PATENT DOCUMENTS

| | | |
|---|---|---|
| CN | 103153110 | 6/2013 |
| DE | 423304 | 1/1926 |
| DE | 601530 | 12/1934 |
| DE | 870963 | 3/1953 |
| DE | 1084173 | 6/1960 |
| DE | 19738433 | 4/1998 |
| DE | 19728848 | 1/1999 |
| DE | 10300012 | 7/2004 |
| EP | 0448714 | 10/1991 |
| EP | 0573886 | 12/1993 |
| EP | 0728860 | 8/1996 |
| EP | 0758693 | 2/1997 |
| EP | 0279950 | 8/1998 |
| EP | 0898002 | 2/1999 |
| EP | 1233091 | 8/2002 |
| EP | 1437057 | 7/2004 |
| EP | 1563752 | 8/2005 |

(56) References Cited

FOREIGN PATENT DOCUMENTS

| | | |
|---|---|---|
| EP | 1602762 | 12/2005 |
| EP | 1972706 | 9/2008 |
| EP | 2600744 | 6/2013 |
| FR | 2171172 | 9/1973 |
| GB | 491000 | 8/1938 |
| GB | 538865 | 8/1941 |
| GB | 2018837 | 10/1979 |
| GB | 1603487 | 11/1981 |
| JP | H6-86702 A | 3/1994 |
| JP | H06113905 | 4/1994 |
| JP | H08109553 | 4/1996 |
| JP | H11302943 | 11/1999 |
| JP | 2003506176 | 2/2003 |
| JP | 2013532574 | 8/2013 |
| NL | 7304678 | 10/1974 |
| WO | 9003744 | 4/1990 |
| WO | 0032861 | 6/2000 |
| WO | 0231247 | 4/2002 |
| WO | 2010080182 | 7/2010 |
| WO | 2012018731 | 2/2012 |

OTHER PUBLICATIONS

Korean Office Action dated Sep. 24, 2014 in Korean Patent Application No. 10-2013-7005242.
Japanese Office Action dated Oct. 7, 2014 in Japanese Patent Application No. 2013-523248.
International Search Report and the Written Opinion mailed Mar. 7, 2012 in International Application No. PCT/US2011/046138.
International Preliminary Report on Patentability (including Written Opinion of the ISA) mailed Feb. 14, 2013 in International Application No. PCT/US2011/046138.
Declaration of Dr. Edward C. Frederick from the US Patent and Trademark Office Inter Partes Review of U.S. Pat. No. 7,347,011 (178 pp).
David J. Spencer, Knitting Technology: A Comprehensive Handbook and Practical Guide (Third ed., Woodhead Publishing Ltd. 2001) (413 pp).
Excerpt of Hannelore Eberle et al., Clothing Technology (Third English ed., Beuth-Verlag GmnH 2002) (book cover and back; pp. 2-3, 83).
International Search Report and Written Opinion in connection with PCT/US2009/056795 mailed on Apr. 20, 2010.
International Search Report and Written Opinion in connection with PCT/US2012/028576 mailed on Oct. 1, 2012.
International Search Report and Written Opinion in connection with PCT/US2012/028559 mailed on Oct. 19, 2012.
International Search Report and Written Opinion in connection with PCT/US2012/028534 mailed on Oct. 17, 2012.
International Preliminary Report on Patentability in connection with PCT/US2012/028534 mailed Sep. 17, 2013.
International Preliminary Report on Patentability in connection with PCT/US2012/028576 mailed Sep. 17, 2013.
Office Action, and English language translation thereof, in corresponding Japanese Application No. 2014-252395, dated Sep. 29, 2015, 4 pages.
Office Action, and English language translation thereof, in corresponding Chinese Application No. 201510144474.8, dated Feb. 2, 2016, 24 pages.
Letter from Bruce Huffa dated Dec. 23, 2013 (71 Pages).
Office Action in U.S. Appl. No. 14/066,754, dated May 26, 2016, 9 pages.

* cited by examiner

METHOD OF LASTING AN ARTICLE OF FOOTWEAR

CROSS-REFERENCE TO RELATED APPLICATIONS

This application is a division of U.S. patent application Ser. No. 14/066,754, entitled "Method of Lasting An Article Of Footwear", filed on Oct. 30, 2013, which application is a division of U.S. patent application Ser. No. 12/848,352, entitled "Method of Lasting An Article Of Footwear", filed on Aug. 2, 2010, and issued as U.S. Pat. No. 8,595,878 on Dec. 3, 2013, the disclosures of which applications are hereby incorporated by reference in their entirety.

BACKGROUND

Articles of footwear generally include two primary elements: an upper and a sole structure. The upper may be formed from a variety of material elements (e.g., textiles, polymer sheets, foam layers, leather, synthetic leather) that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates a sockliner, a polymer foam midsole, and a rubber outsole.

A common method of manufacturing an article of footwear involves the use of a lasting process. More particularly, a majority of the upper is formed and placed around a last, which has the general shape of a foot. Various methods are then utilized to tighten the upper around the last, thereby imparting the general shape of the foot to the void within the upper. In order to tighten the upper of athletic footwear around a last, for example, a strobel material is often secured to a lower perimeter of the upper and stretched across an area of the last corresponding with a lower surface of the foot. The sole structure is then secured to the lower perimeter of the upper and the strobel material to substantially complete manufacturing.

SUMMARY

Numerous aspects and variations of a method of manufacturing an article of footwear are disclosed below. The method may include assembling at least a portion of an upper of the article of footwear, the upper having a lower perimeter edge. A lasting element is secured to the upper. The lasting element includes (a) a first strip joined to a lateral side of the upper adjacent to the lower perimeter edge, (b) a second strip joined to a medial side of the upper adjacent to the lower perimeter edge, and (c) at least one strand extending through the first strip and the second strip. The strand is tensioned, and a sole structure of the article of footwear is joined to the upper.

The method may also include placing at least a portion of an upper of the article of footwear over a last, the upper having a lower perimeter edge. A lasting element is secured to the upper. The lasting element includes (a) a first strip joined to a lateral side of the upper adjacent to the lower perimeter edge, (b) a second strip joined to a medial side of the upper adjacent to the lower perimeter edge, and (c) at least one strand that passes through the first strip and the second strip and forms a w-shaped configuration between the first strip and the second strip. The strand is tensioned to tighten the upper around the last, and a sole structure of the article of footwear is joined to the upper.

Additionally, the method may include forming a lasting element of unitary knit construction, the lasting element including (a) a pair of textile strips and (b) at least one strand that passes through the textile strips and forms a w-shaped configuration between the textile strips. At least a portion of an upper of the article of footwear is placed over a last. The lasting element is secured to the upper, the strand is tensioned to tighten the upper around the last, and a sole structure of the article of footwear is joined to the upper.

A method of manufacturing an article of footwear may also include forming a knitted component that defines an interior void for receiving a foot, includes a pair of opposite sides, and has at least one strand that passes through the opposite sides and forms a w-shaped configuration between the opposite sides. The knitted component is placed over a last, and the strand is tensioned to tighten the knitted component around the last. A sole structure may then be joined to the knitted component.

The advantages and features of novelty characterizing aspects of the invention are pointed out with particularity in the appended claims. To gain an improved understanding of the advantages and features of novelty, however, reference may be made to the following descriptive matter and accompanying figures that describe and illustrate various configurations and concepts related to the invention.

FIGURE DESCRIPTIONS

The foregoing Summary and the following Detailed Description will be better understood when read in conjunction with the accompanying figures.

DETAILED DESCRIPTION

The following discussion and accompanying figures disclose various configurations of an article of footwear 10, as well as methods of manufacturing footwear 10. Concepts related to footwear 10 are disclosed with reference to configurations that are suitable for running, but may be utilized with a wide range of athletic footwear styles, including basketball shoes, cross-training shoes, cycling shoes, football shoes, soccer shoes, tennis shoes, and walking shoes, for example. Additionally, the concepts associated with footwear 10 may also be utilized with footwear styles that are generally considered to be non-athletic, including dress shoes, loafers, sandals, and boots. Accordingly, the concepts related to footwear 10 may apply to a variety of footwear configurations and methods of manufacturing the footwear configurations.

General Footwear Configuration

Figure 1:
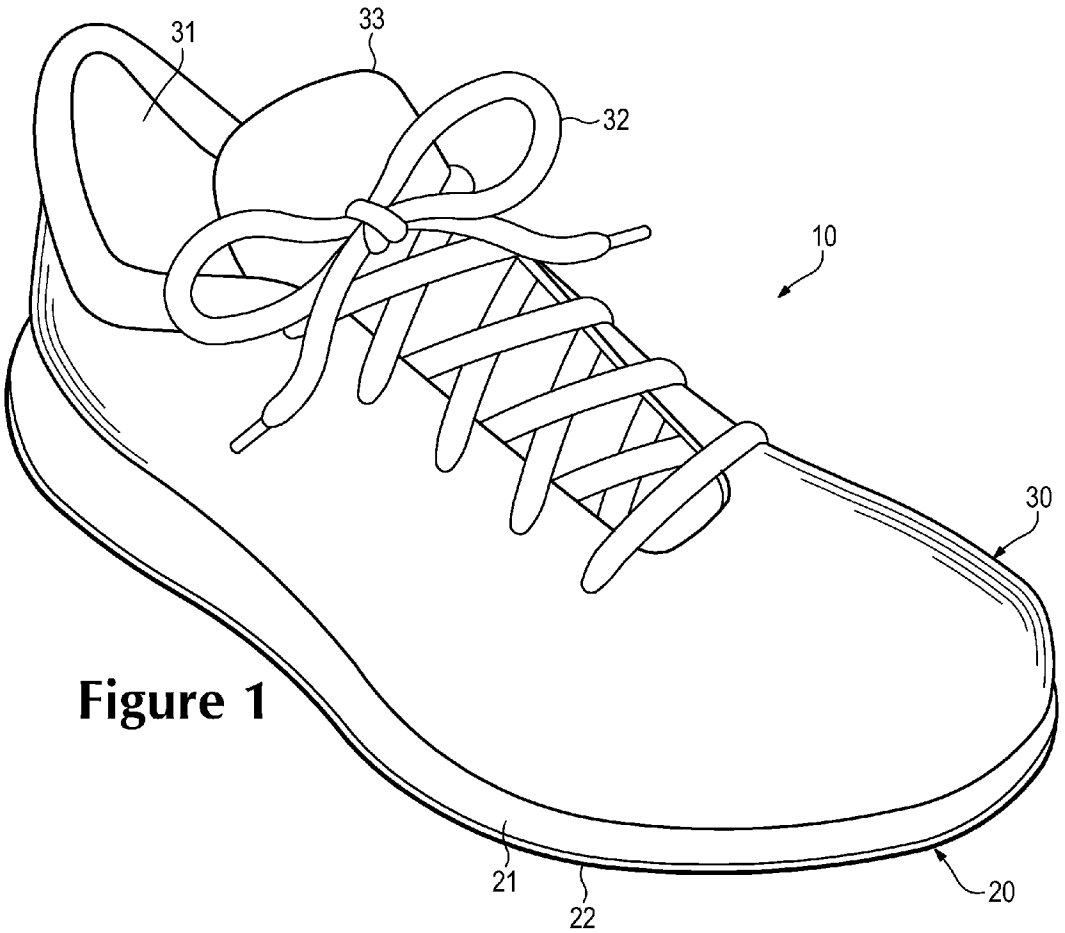
FIG. 1 is a perspective view of an article of footwear.
Figure 2:
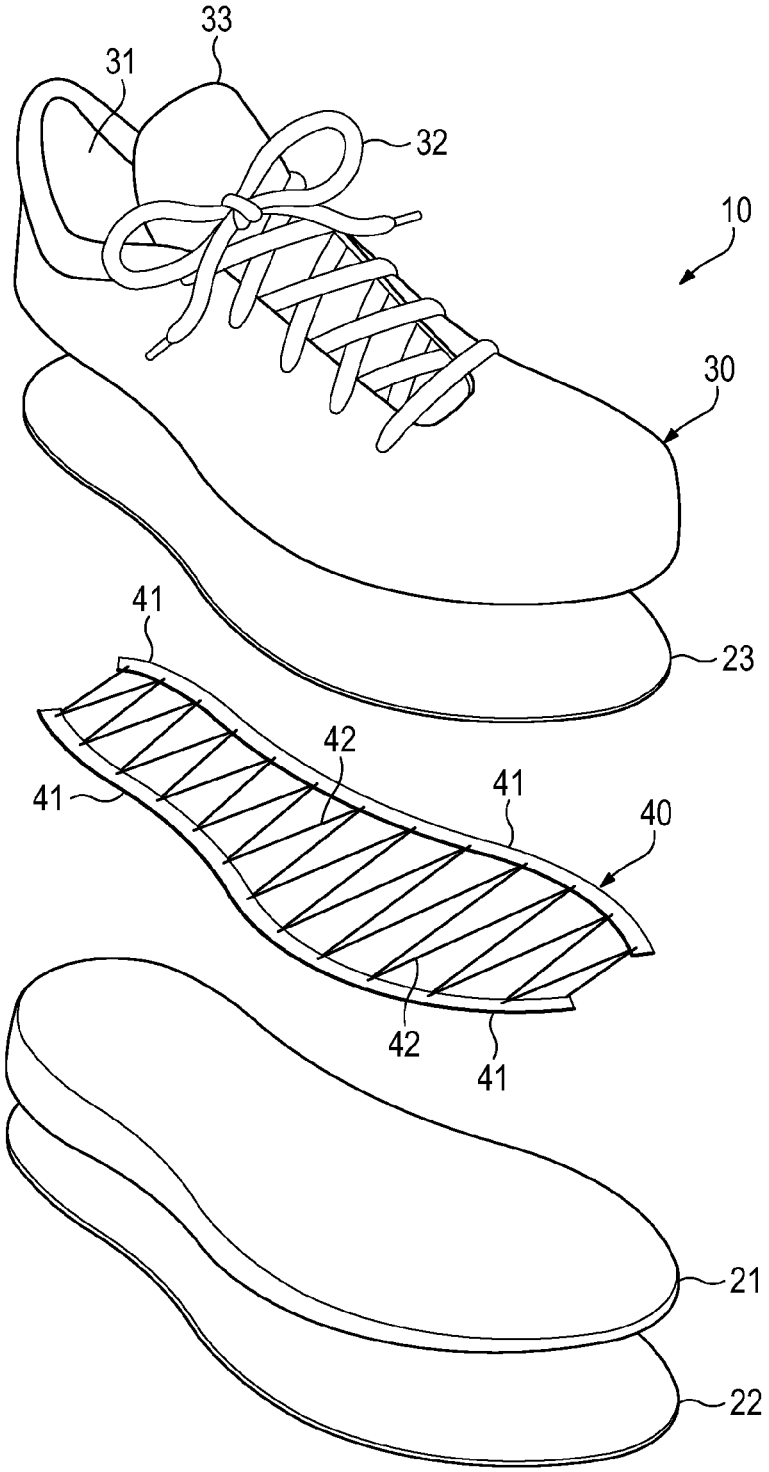
FIG. 2 is an exploded perspective view of the article of footwear.
Figure 3:
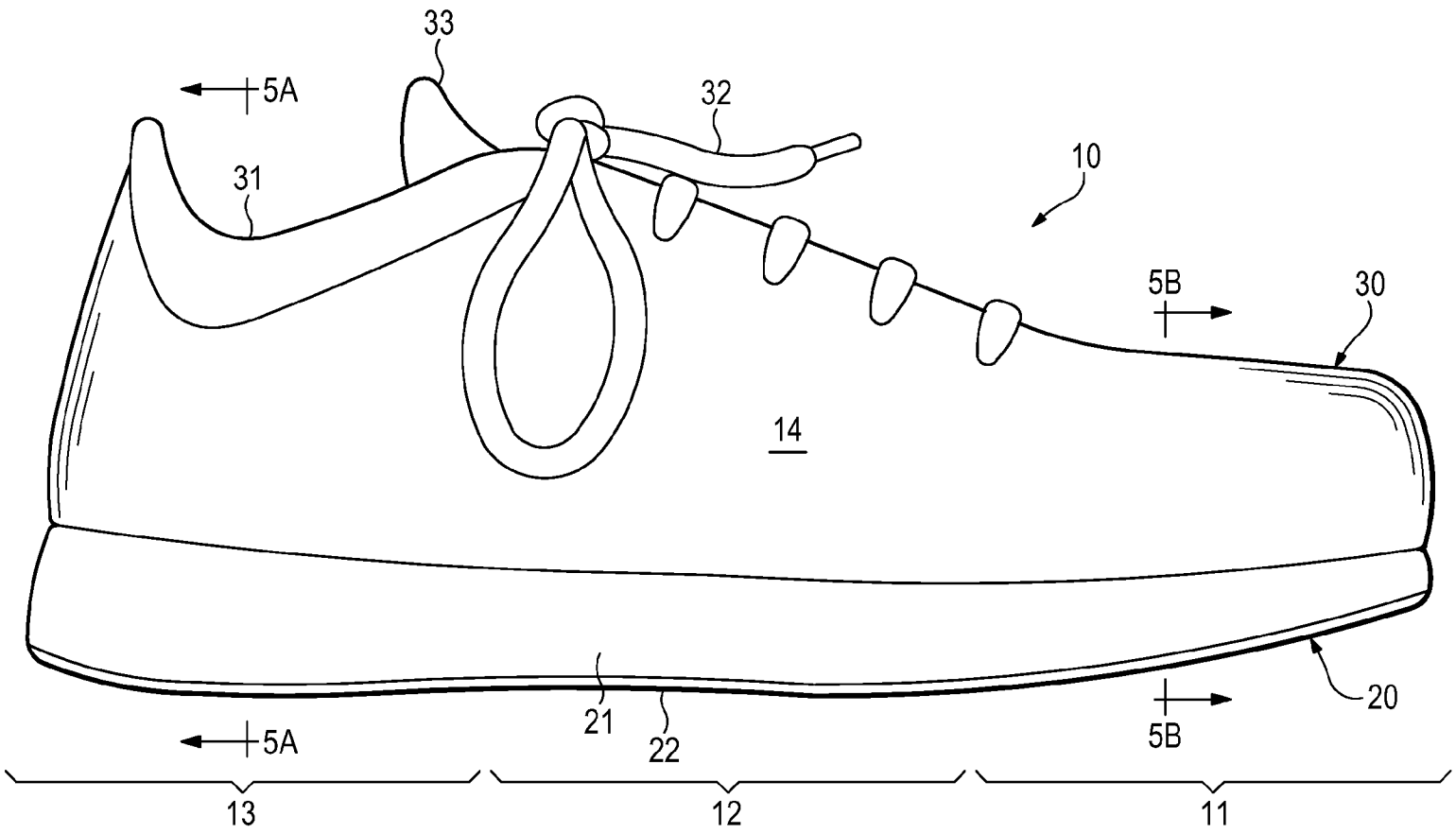
FIG. 3 is a lateral side elevational view of the article of footwear.
Figure 4:
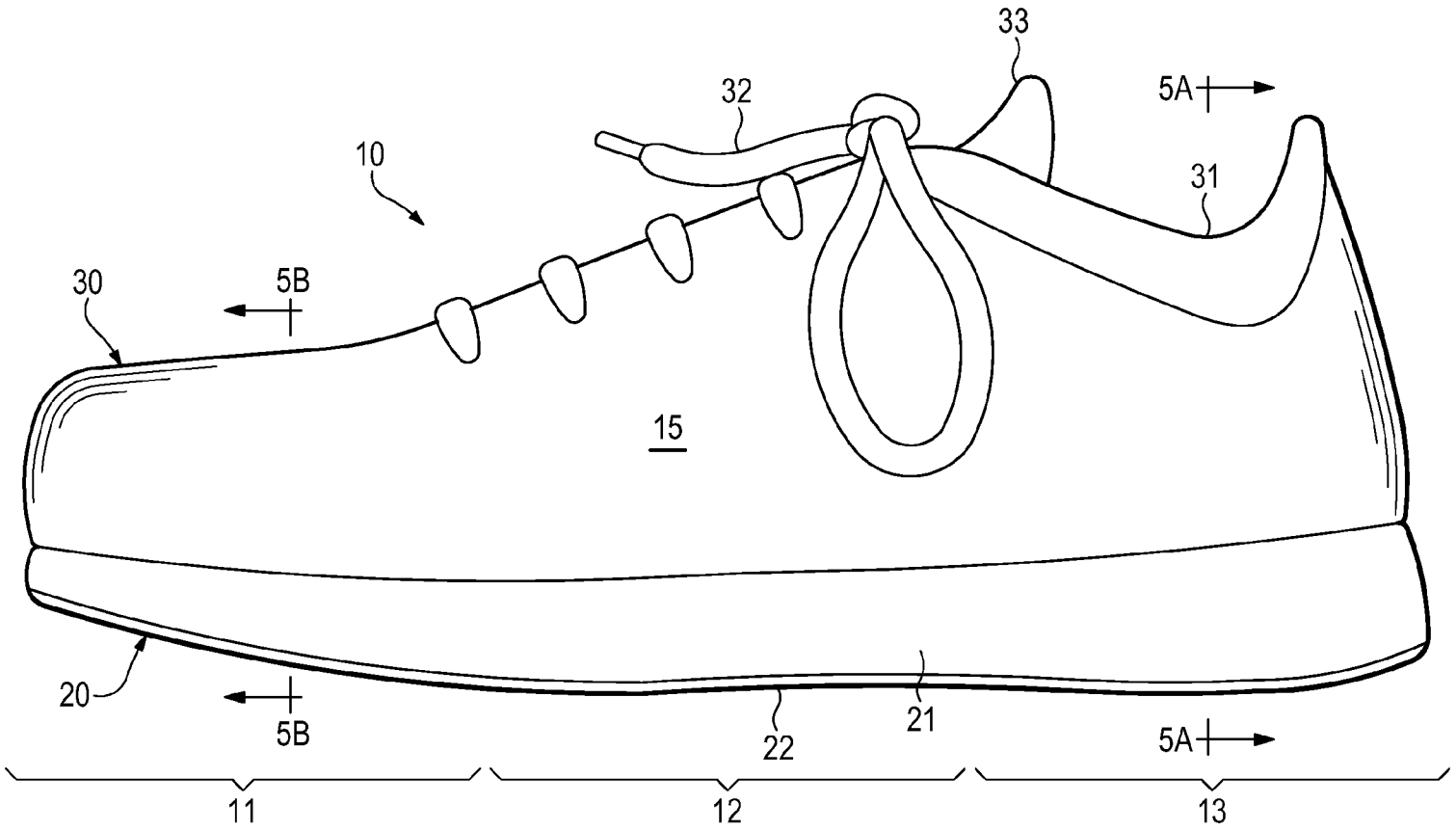
FIG. 4 is a medial side elevational view of the article of footwear.

Footwear 10 is depicted in FIGS. 1-5B as including a sole structure 20 and an upper 30. For reference purposes, footwear 10 may be divided into three general regions: a forefoot region 11, a midfoot region 12, and a heel region 13, as shown in FIGS. 3 and 4. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with an arch area of the foot. Heel region 13 generally corresponds with rear portions of the foot, including the calcaneus bone. Lateral side 14 and medial side 15 extend through each of regions 11-13 and correspond with opposite sides of footwear 10. Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be applied to sole structure 20, upper 30, and individual elements thereof.

Sole structure 20 is secured to upper 30 and extends between the foot and the ground when footwear 10 is worn. The primary elements of sole structure 20 are a midsole 21 and an outsole 22. Midsole 21 is secured to a lower area of upper 30 and may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In further configurations, midsole 21 may incorporate plates, moderators, fluid-filled chambers, lasting elements, or motion control members that further attenuate forces, enhance stability, or influence the motions of the foot, or midsole 21 may be primarily formed from a fluid-filled chamber. Outsole 22 is secured to a lower surface of midsole 21 and may be formed from a wear-resistant rubber material that is textured to impart traction. A sockliner 23 may also be located within upper 30 and positioned to extend under a lower surface of the foot. Although this configuration for sole structure 20 provides an example of a sole structure that may be used in connection with upper 30, a variety of other conventional or nonconventional configurations for sole structure 20 may also be utilized. Accordingly, the configuration and features of sole structure 20 or any sole structure utilized with upper 30 may vary considerably.

Upper 30 defines a void within footwear 10 for receiving and securing a foot relative to sole structure 20. The void is shaped to accommodate the foot and extends along the lateral side of the foot, along the medial side of the foot, over the foot, around the heel, and under the foot. Access to the void is provided by an ankle opening 31 located in at least heel region 13. A lace 32 extends through various apertures or other lace-receiving elements (e.g., D-rings, hooks) in upper 30 and permits the wearer to modify dimensions of upper 30 to accommodate the proportions of the foot. More particularly, lace 32 permits the wearer to tighten upper 30 around the foot, and lace 32 permits the wearer to loosen upper 30 to facilitate entry and removal of the foot from the void (i.e., through ankle opening 31). Upper 30 also includes a tongue 33 that extends between the interior void and lace 32. In addition, for example, upper 30 may incorporate a heel counter located in heel region 13 that limits heel movement or a wear-resistant toe guard located in forefoot region 11 that imparts wear-resistance.

The various portions of upper 30 may be formed from one or more of a plurality of material elements (e.g., textiles, polymer sheets, foam layers, leather, synthetic leather) that are stitched or bonded together to form the void within footwear 10. A lower area or lower perimeter of upper 30, which is adjacent to sole structure 20 (i.e., an upper surface of midsole 21), defines an perimeter edge 34. As discussed in greater detail below, at least a portion of a lasting element 40, which is utilized in the manufacture (e.g., lasting process) of footwear 10, is secured to or located adjacent to the lower area, the lower perimeter, or perimeter edge 34.

Lasting Element Configurations

Lasting element 40 is depicted in FIGS. 6-8B and includes a pair of strips 41 (e.g., a first strip and a second strip) and a strand 42. Strips 41 are generally spaced from each other, and strand 42 alternately passes through each of strips 41 to form a w-shaped configuration between strips 41. That is, strand 42 passes through one of strips 41 (e.g., the first strip), passes through the other of strips 41 (e.g., the second strip), and continues to repeatedly and alternately pass through each of strips 41. In this way, a portion of strand 42 forms the w-shaped configuration between strips 41, which may also be described as forming a zigzag or wave-like configuration between strips 41.

Figure 6:
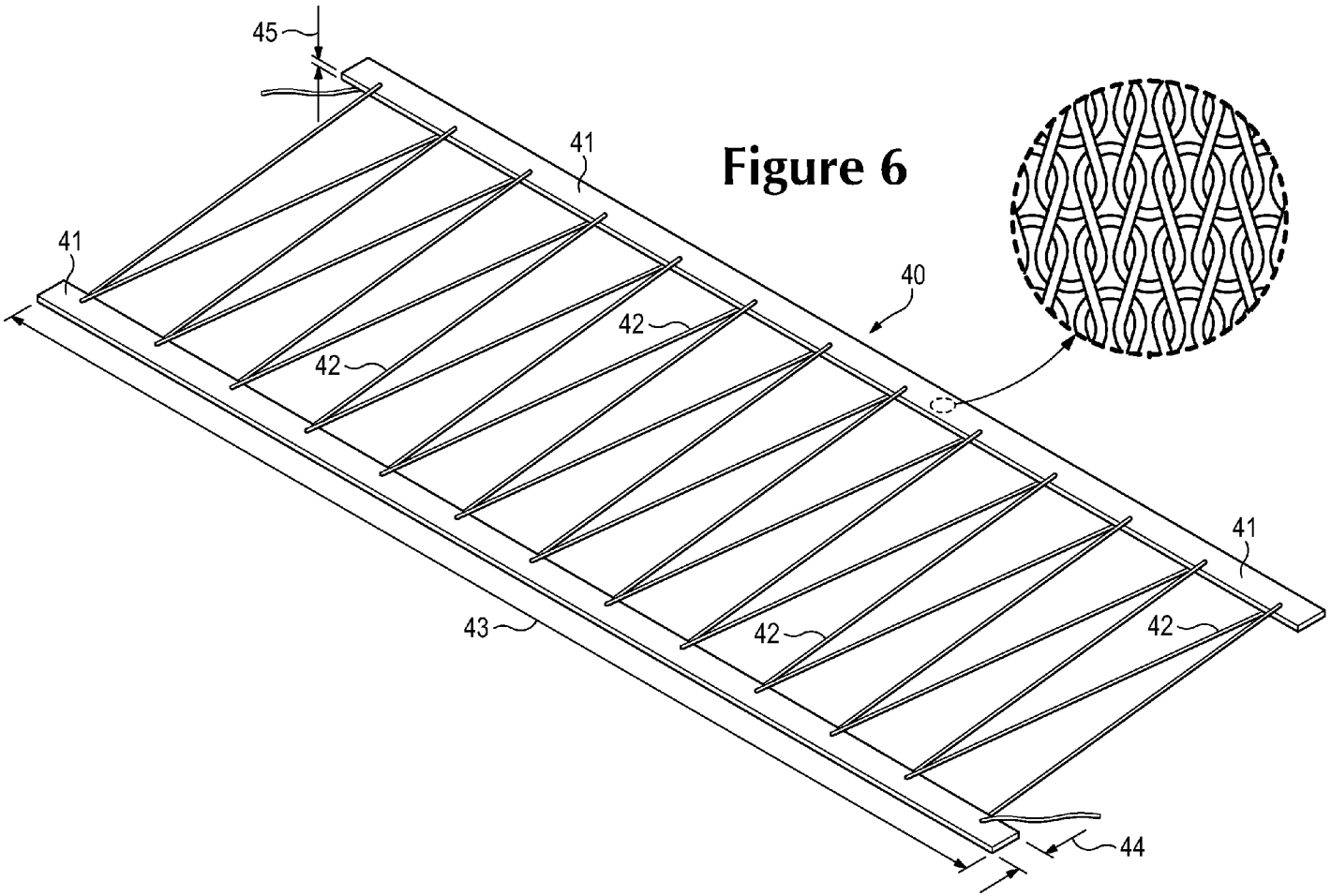
FIG. 6 is a perspective view of a lasting element of the article of footwear.
Figure 7:
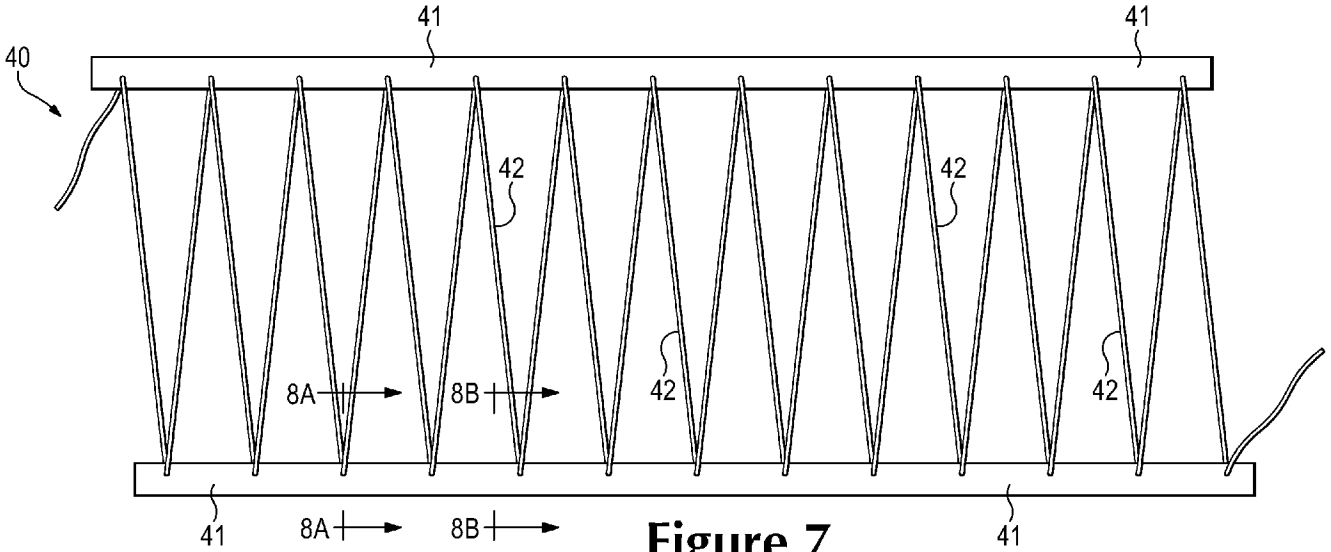
FIG. 7 is a plan view of the lasting element.
Figure 8B:
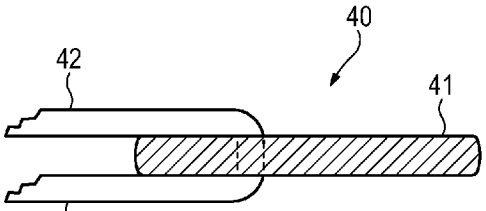
FIGS. 8A and 8B are cross-sectional views of the lasting element, as respectively defined by section lines 8A and 8B in FIG. 7.
Figure 8A:
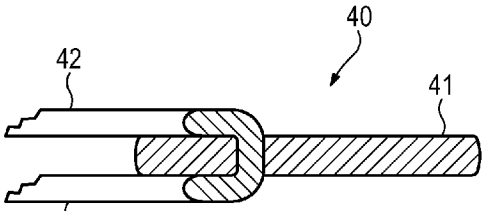

Strips 41 are generally positioned parallel to each other, but may curve to follow the contours or shape of perimeter edge 34 when incorporated into footwear 10. Referring to FIG. 6, a length 43, a width 44, and a thickness 45 of one of strips 41 is defined. In general, length 43 is significantly greater than either of width 44 and thickness 45. Moreover, width 44 is greater than thickness 45. This configuration imparts a generally rectangular and planar aspect to each of strips 41. Strand 42 extends through each of strips 41. When strips 41 are formed from polymer sheets, for example, strips 41 may define apertures or other holes through which strand 42 passes. When strips 41 are formed from textiles, for example, strand 42 may pass between adjacent yarns.

A variety of materials may be utilized for the various components of lasting element 40. For example, strips 41 may be formed from textiles, polymer sheets, leather, synthetic leather, or combinations of these materials (e.g., a thermoplastic polymer sheet bonded to a textile). Strands 42 may be formed from a variety of filaments, fibers, yarns, threads, cables, or ropes that are produced from rayon, nylon, polyester, polyacrylic, silk, cotton, carbon, glass, aramids (e.g., para-aramid fibers and meta-aramid fibers), ultra high molecular weight polyethylene, liquid crystal polymer, copper, aluminum, and steel, for example. Accordingly, the materials and combinations of materials utilized for lasting element 40 (i.e., each of strips 41 and strand 42) may vary considerably.

Although different configurations of lasting element 40 may be formed from a variety of materials, lasting element 40 may also be formed as a one-piece element through a knitting process, such flat-knitting. More particularly, lasting element 40 may be formed of unitary knit construction through the flat-knitting process. As an alternative to flat-knitting, lasting element 40 may be formed through weaving or warp-knitting with a weft insertion. As utilized herein, a knitted component such as lasting element 40 is defined as being formed of "unitary knit construction" when substantially constructed as a one-piece knit element through a knitting process. That is, the knitting process substantially forms and assembles the various features and structures of lasting element 40 (i.e., strips 41 and stand 42). In many examples of a process that forms lasting element 40 of unitary knit construction, a knitting machine is utilized to (a) form each of strips 41 and (b) repeatedly and alternately pass strand 42 through each of strips 41. That is, the knitting process utilized to form lasting element 40 of unitary knit construction generally involves (a) mechanically-manipulating one or more yarns to form a series of stitches that define strips 41 and (b) laying strand 42 through strips 41.

Forming lasting element 40 of unitary knit construction imparts various advantages. For example, lasting element 40 may be efficiently-manufactured from yarns that are mechanically-manipulated with a knitting machine. That is, the knitting machine may be automated to manufacture lasting element 40 from yarn components. Moreover, the specific yarns utilized for strips 41, different areas of strips 41, and strand 42 may be selected and located through the knitting process. In addition, the knitting process may also be utilized to form a relatively long length of strips 41 and stand 42, and then individual lasting elements 40 for different articles of footwear, including footwear 10, may be cut from the relatively long length of strips 41 and stand 42. As a further example, a single knitting machine may be utilized to form different lasting elements 40 with different properties. That is, length 43, width 44, thickness 45, the spacing between strips 41, the location of strand 42, and the yarns utilized for strips 41 and strand 42, for example, may be varied through modifications in the knitting process. Accordingly, utilizing a knitting process to form lasting element 40 of unitary knit construction may impart advantages over separately forming and assembling strips 41 and stand 42.

A variety of different types of yarns may be incorporated into lasting element 40 during the knitting process. Although strips 41 and strand 42 may be formed from the same yarn or type of yarn, strips 41 and strand 42 may also be formed from separate yarns with different properties. As examples, the yarns forming strips 41 and strand 42 may incorporate polyester, nylon, acrylic, rayon, cotton, wool, and silk. The yarns may be monofilament yarns or multifilament yarns, and the yarns may include separate filaments that are each formed of different materials. Moreover, the yarns may include filaments that are each formed of two or more different materials. Yarns with different degrees of twist and crimping, as well as different deniers, may also be utilized for strips 41 and strand 42. Materials of the yarns may also be selected to retain an intended shape when heat set. Accordingly, various types of yarn and yarn materials may be incorporated into the components of lasting element 40.

Any of the yarn materials discussed above may be utilized for strand 42. As discussed in greater detail below, however, strand 42 may be tightened or tensioned during the manufacturing process of footwear 10. As such, the manufacturing process may benefit from forming strand 42 from a relatively non-stretch yarn. Accordingly, strand 42 may be formed from a variety of filaments, fibers, yarns, threads, cables, or ropes that are formed from carbon fibers, glass fibers, aramids (e.g., para-aramid fibers and meta-aramid fibers), ultra high molecular weight polyethylene materials, liquid crystal polymer materials, copper, aluminum, and steel, for example. Accordingly, strand 42 may be formed from a variety of materials with different configurations.

Based upon the above discussion, lasting element 40 is secured to or located adjacent to the lower area, the lower perimeter, or perimeter edge 34 of upper 30. In general, lasting element 40 includes strips 41 and strand 42. Whereas strips 41 are generally spaced from each other, strand 42 alternately passes through each of strips 41 to form a w-shaped configuration, a zigzag configuration, or a wave-like configuration between strips 41. Although strips 41 and strand 42 may be formed separately and assembled, lasting element 40 may also be formed of unitary knit construction through a knitting process, such flat-knitting. Moreover, the materials utilized in strips 41 and strands 42 (e.g., the materials of yarns forming lasting element 40) may vary to impart specific properties to lasting element 40.

Manufacturing Process

Figure 9A:
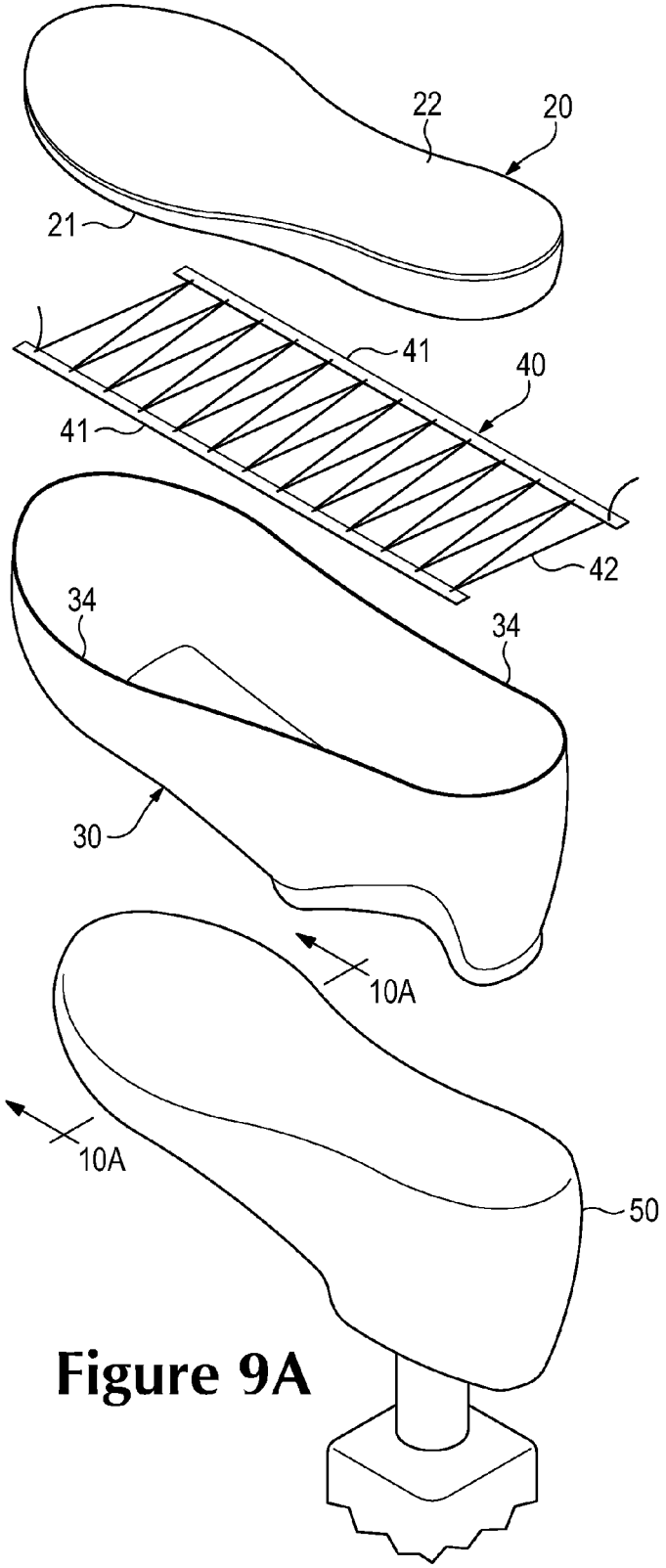
FIGS. 9A-9H are perspective views of a manufacturing process for the article of footwear.

A variety of techniques may be utilized to manufacture footwear 10. An example of a manufacturing process that incorporates the use of lasting element 40 is discussed below in relation to FIGS. 9A-9H and 10A-10G. Referring to FIG. 9A, an initial stage of the manufacturing process is shown, wherein various separate elements of footwear 10 (e.g., portions of sole structure 20, upper 30, and lasting element 40) are present and located proximal to a last 50. At this stage, upper 30 is generally assembled from various material elements (e.g., textiles, polymer sheets, foam layers, leather, synthetic leather) that are stitched or bonded together. A lower area of upper 30, which faces upward in FIG. 9A, defines perimeter edge 34.

Figure 10A:
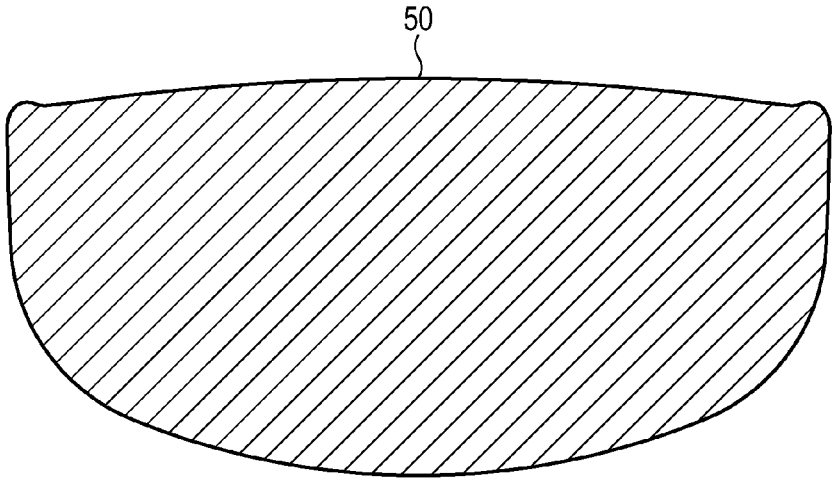
FIGS. 10A-10G are cross-sectional views of the manufacturing process, as respectively defined by section lines 10A-10G in FIGS. 9A-9G.

Last 50 may have a conventional last configuration and has the general shape of a foot, as well as portions of an ankle. As oriented in FIG. 9A, portions of last 50 corresponding with a lower surface of the foot face upwards, portions of last 50 corresponding with an upper surface of the foot face downwards, portions of last 50 corresponding with the toes face toward the upper-left, and portions of last 50 corresponding with the heel face toward the lower-right. Referring to FIG. 10A, a cross-sectional view through a portion of last 50 corresponding with a forefoot region of the foot is depicted. Although last 50 is depicted as having a solid configuration, last 50 may also be formed from multiple, movable elements that vary the overall shape of last 50.

Figure 9B:
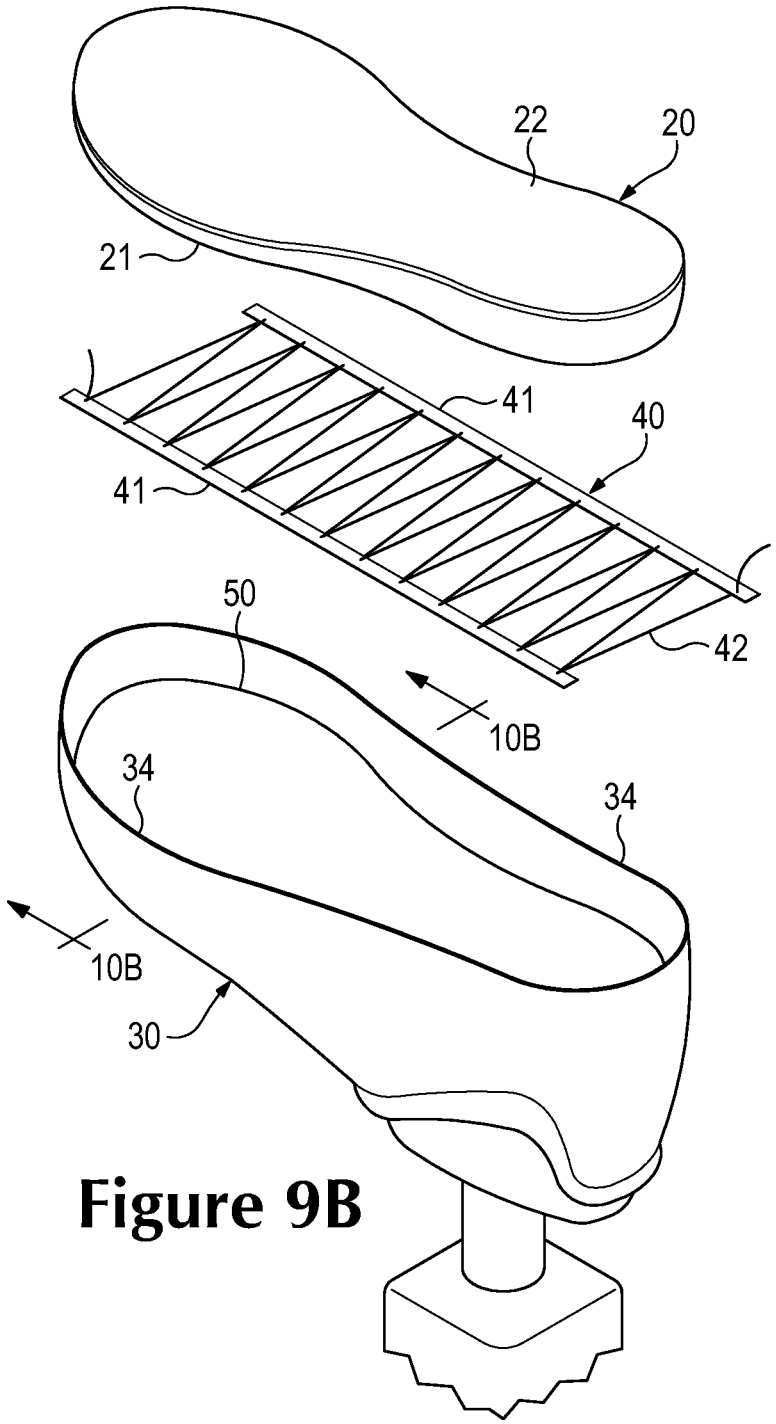
Figure 10B:
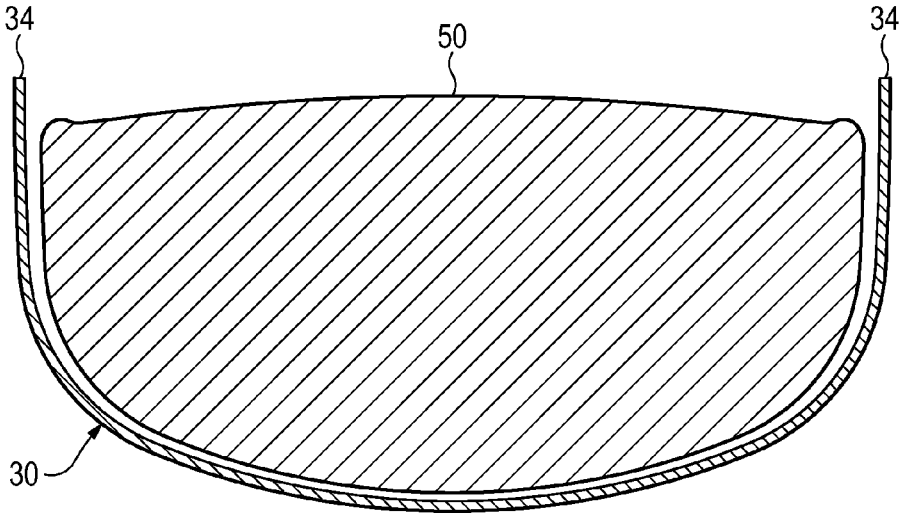

Upper 30 is now placed over last 50, as depicted in FIGS. 9B and 10B, and covers areas of last 50. More particularly, upper 30 covers portions of last 50 corresponding with the lateral and medial side of the foot, the upper surface of the foot, and the heel area of the foot. At this stage of the manufacturing process, however, portions of last 50 corresponding with the lower surface of the foot are exposed. That is, perimeter edge 34 forms an aperture or opening in upper 30 that exposes portions of last 50 corresponding with the lower surface of the foot.

Figure 9C:
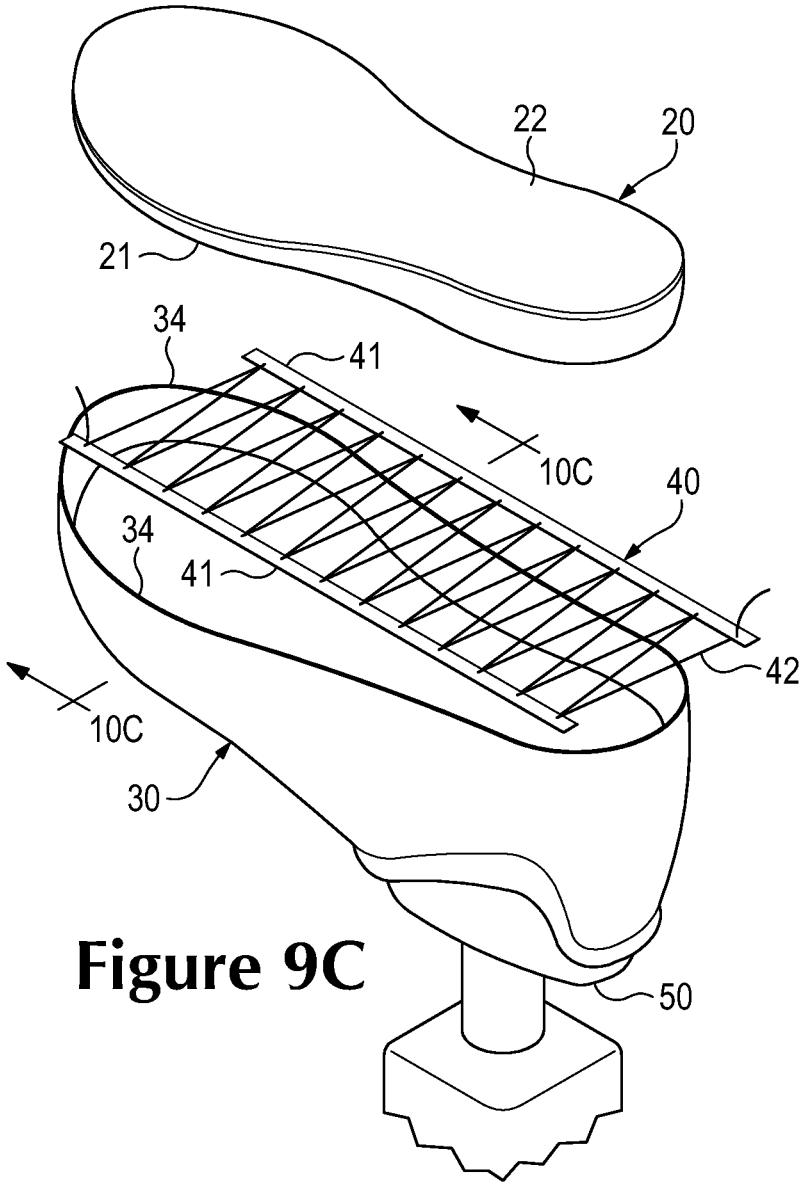
Figure 9D:
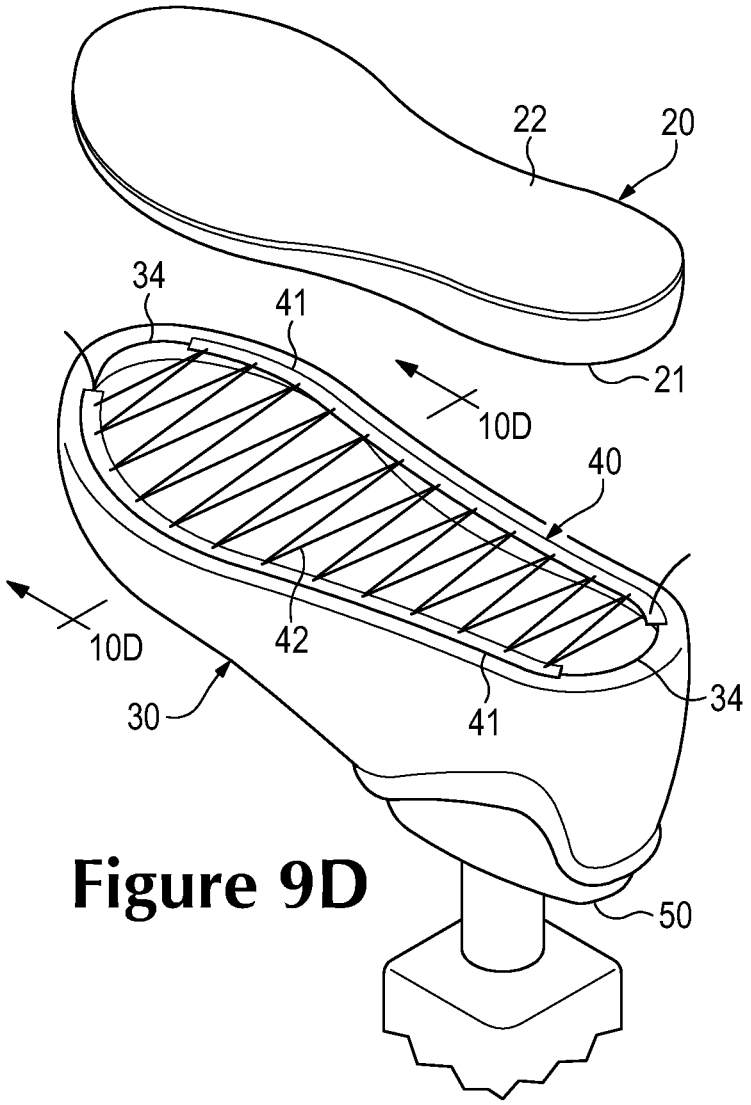
Figure 10C:
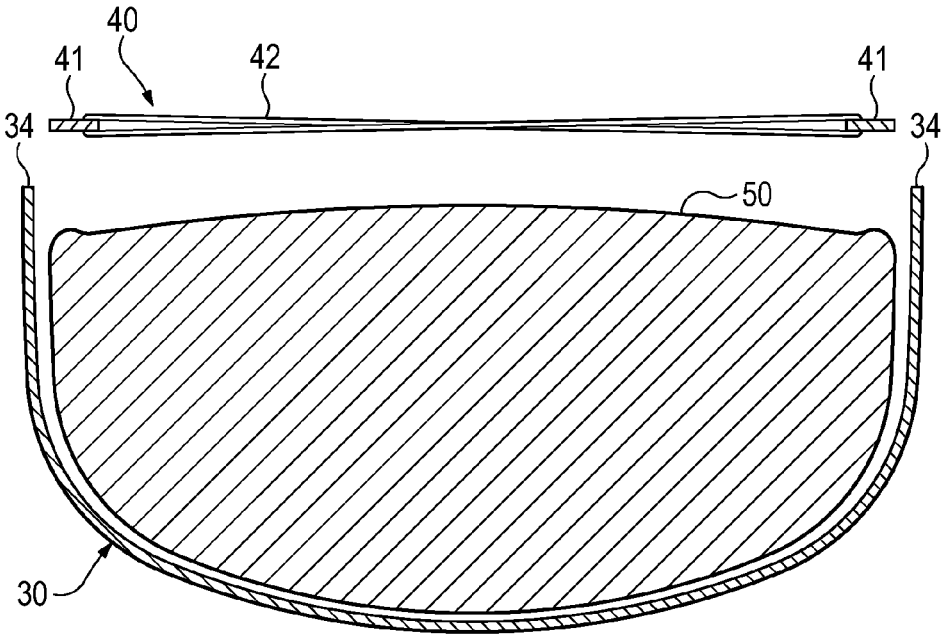
Figure 10D:
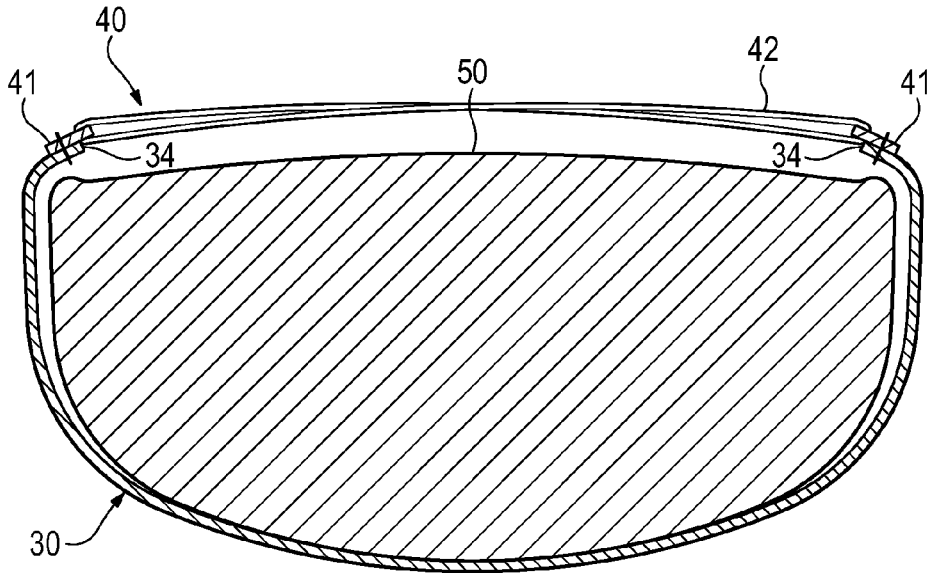

Once upper 30 is placed over last 50, lasting element 40 is located proximal to the lower area of upper 30, as depicted in FIGS. 9C and 10C. Lasting element 40 is then secured to the lower area of upper 30, which forms perimeter edge 34, as depicted in FIGS. 9D and 10D. Although a variety of methods may be utilized to join lasting element 40 with the lower area of upper 30, stitching, thermal bonding, adhesive bonding, or a combination of these methods may each be utilized. Moreover, lasting element 40 is secured to the lower area of upper 30 such that (a) one of strips 41 is joined with lateral side 14 of upper 30 from forefoot region 11 to heel region 13 and (b) the other of strips 41 is joined with medial side 15 of upper 30 from forefoot region 11 to heel region 13. As an additional matter, strips 41 are depicted as overlapping perimeter edge 34 such that (a) a portion of each of strips 41 lays against a surface of upper 30 and (b) another portion of each of strips 41 extends outward from perimeter edge 34, but a variety of other configurations may be utilized.

Figure 9E:
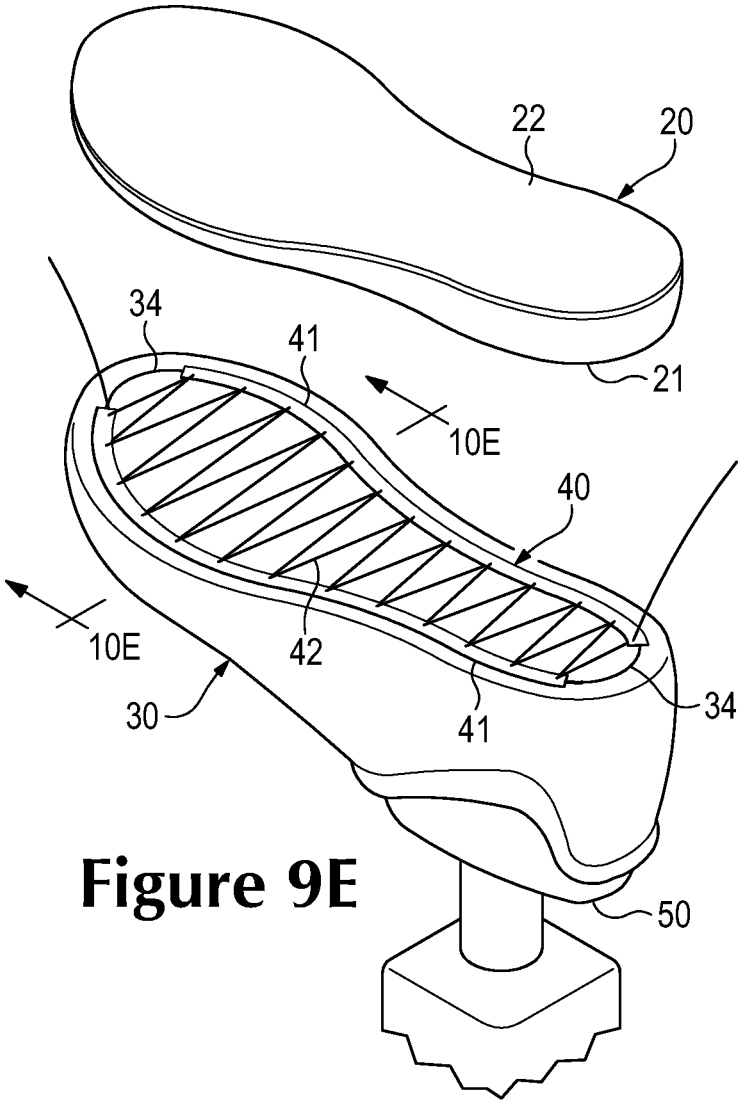
Figure 10E:
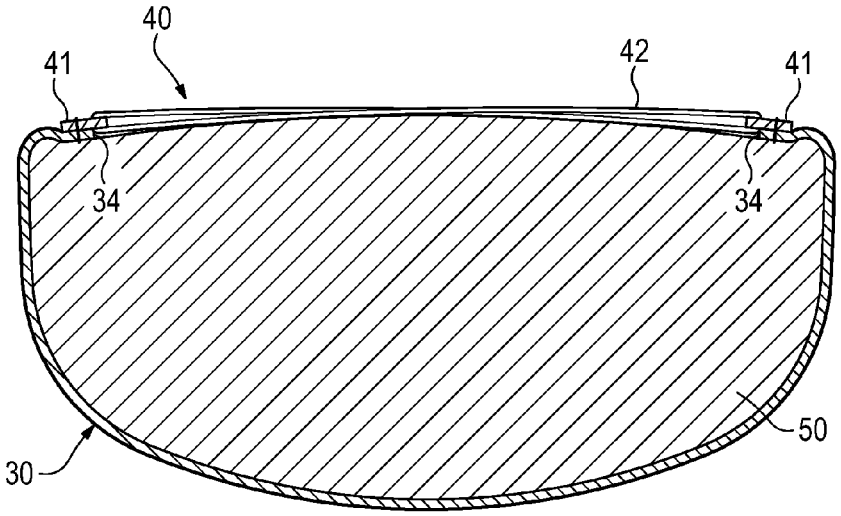

At this stage of the manufacturing process, upper 30 extends over last 50 in a relatively loose manner. Referring to FIG. 10D, for example, various gaps are formed between upper 30 and last 50 due to the relatively loose-fitting configuration of upper 30 over last 50. In order to tighten upper 30 around last 50, however, strand 42 is pulled or otherwise placed in tension, as depicted in FIGS. 9E and 10E. By tensioning strand 42, upper 30 is drawn against surfaces of last 50 to induce upper 30 to take on the shape of last 50. That is, tensioning strand 42 induces the void within upper 30 to take on the shape of a foot. Given that strand 42 extends through strips 41 and is able to move or slide through strips 41, tensioning strand 42 also has the effect of drawing strips 41 closer to each other along substantially all of a length of upper 30. In general, therefore, tensioning strand 42 has the effect of (a) tightening upper 30 around last 50 and (b) drawing strips 41 closer to each other.

Figure 9F:
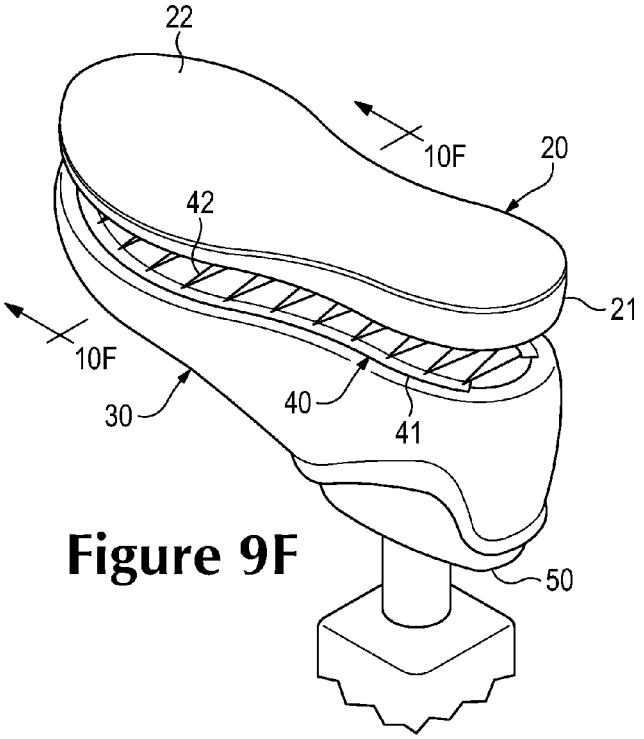
Figure 9G:
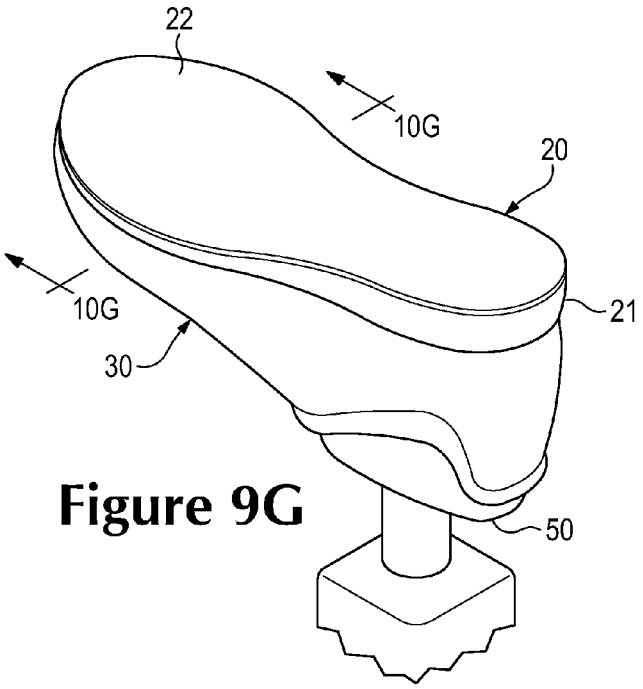
Figure 9H:
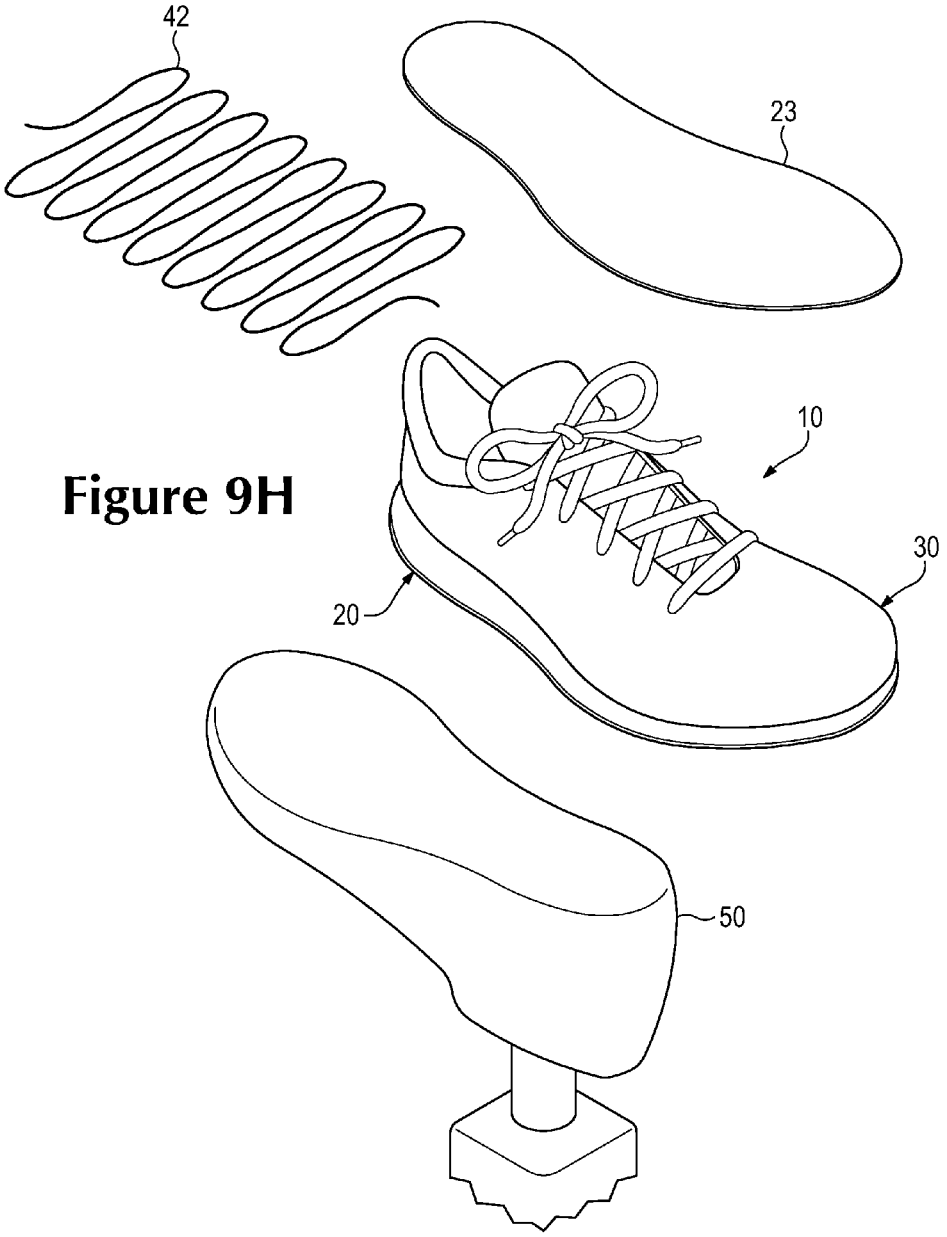
Figure 10F:
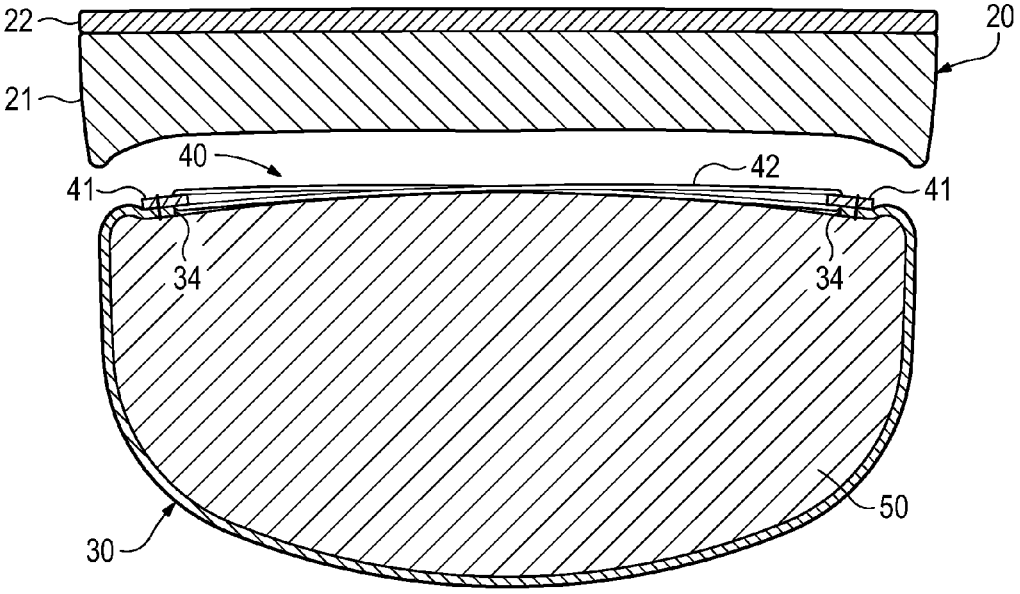
Figure 10G:
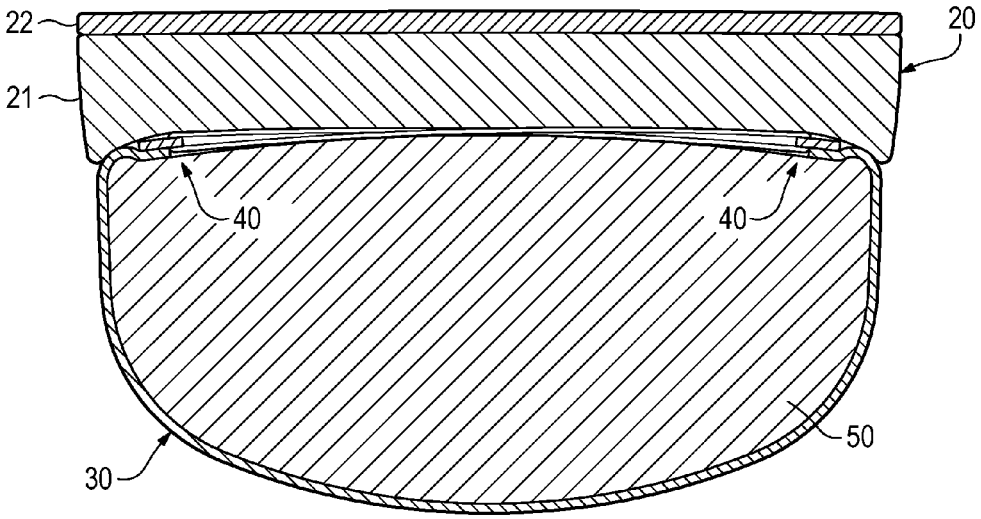

Following the tightening of strand 42, sole structure 20 is located proximal to lasting element 40 and the lower area of upper 30, as depicted in FIGS. 9F and 10F. Sole structure 20 is then secured to lasting element 40 and the lower area of upper 30, as depicted in FIGS. 9G and 10G. Although a variety of methods may be utilized to join sole structure 20 with lasting element 40 and the lower area of upper 30, stitching, thermal bonding, adhesive bonding, or a combination of these methods may each be utilized. Once sole structure 20 is secured, footwear 10 may be removed from last 50, as depicted in FIG. 9H. Optionally, strand 42 may also be removed from footwear 10 and through ankle opening 31. That is, strand 42 may be displaced from strips 41 and removed from the void formed by upper 30, which is where last 50 was previously located. Also, sockliner 23 may be placed within the void formed by upper 30 to substantially complete the manufacture of footwear 10.

Based upon the above discussion, footwear 10 may be manufactured through a process that generally includes placing at least a portion of upper 30 over last 50. Lasting element 40, which may be previously formed through knitting to have a unitary knit construction, is then secured to upper 30. More particularly, (a) one of strips 41 is joined with lateral side 14 of upper 30 from forefoot region 11 to heel region 13 and (b) the other of strips 41 is joined with medial side 15 of upper 30 from forefoot region 11 to heel region 13. Strand 42 is then tensioned to tighten upper 30 around last 50, and sole structure 20 is joined to one or both of lasting element 40 and upper 30.

Further Configurations

Figure 11A:
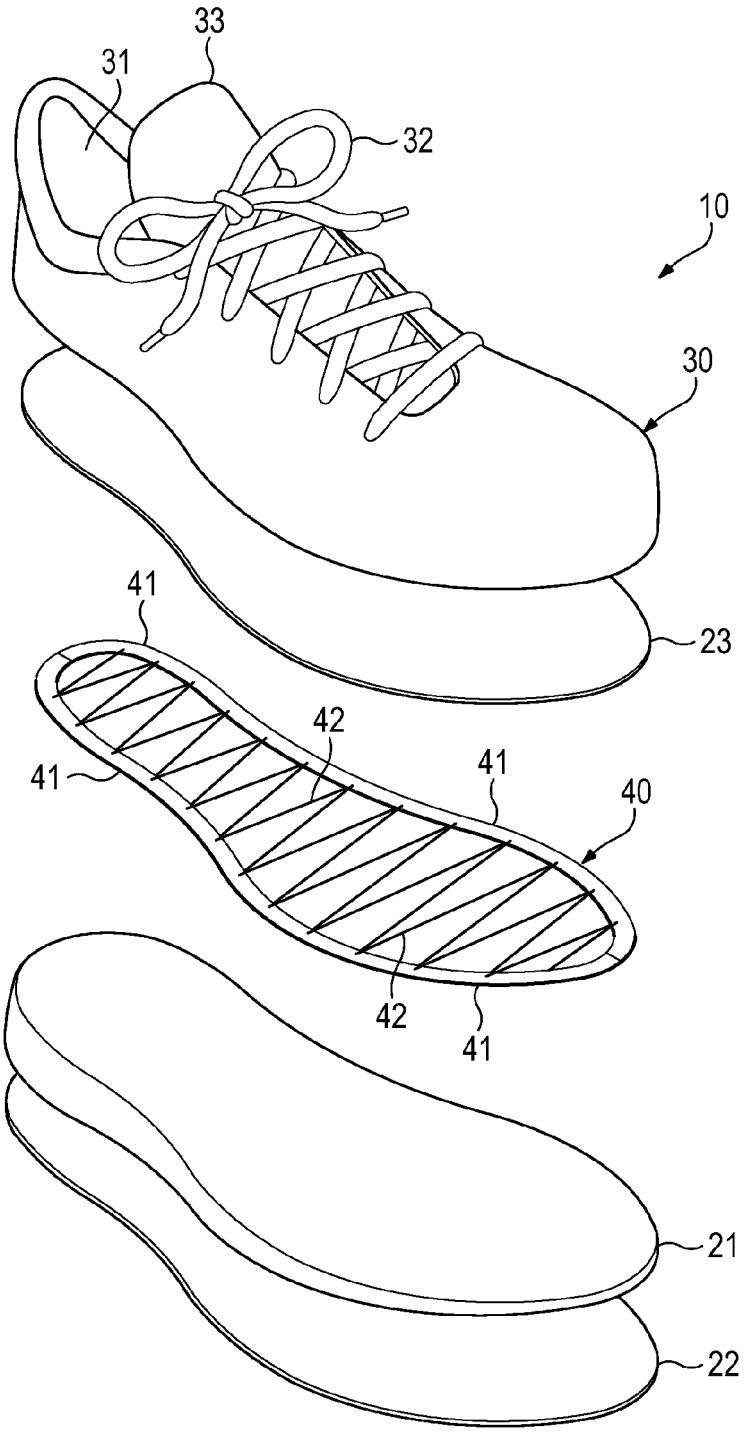
FIGS. 11A-11C are perspective views corresponding with FIG. 2 and depicting further configurations of the article of footwear.
Figure 11B:
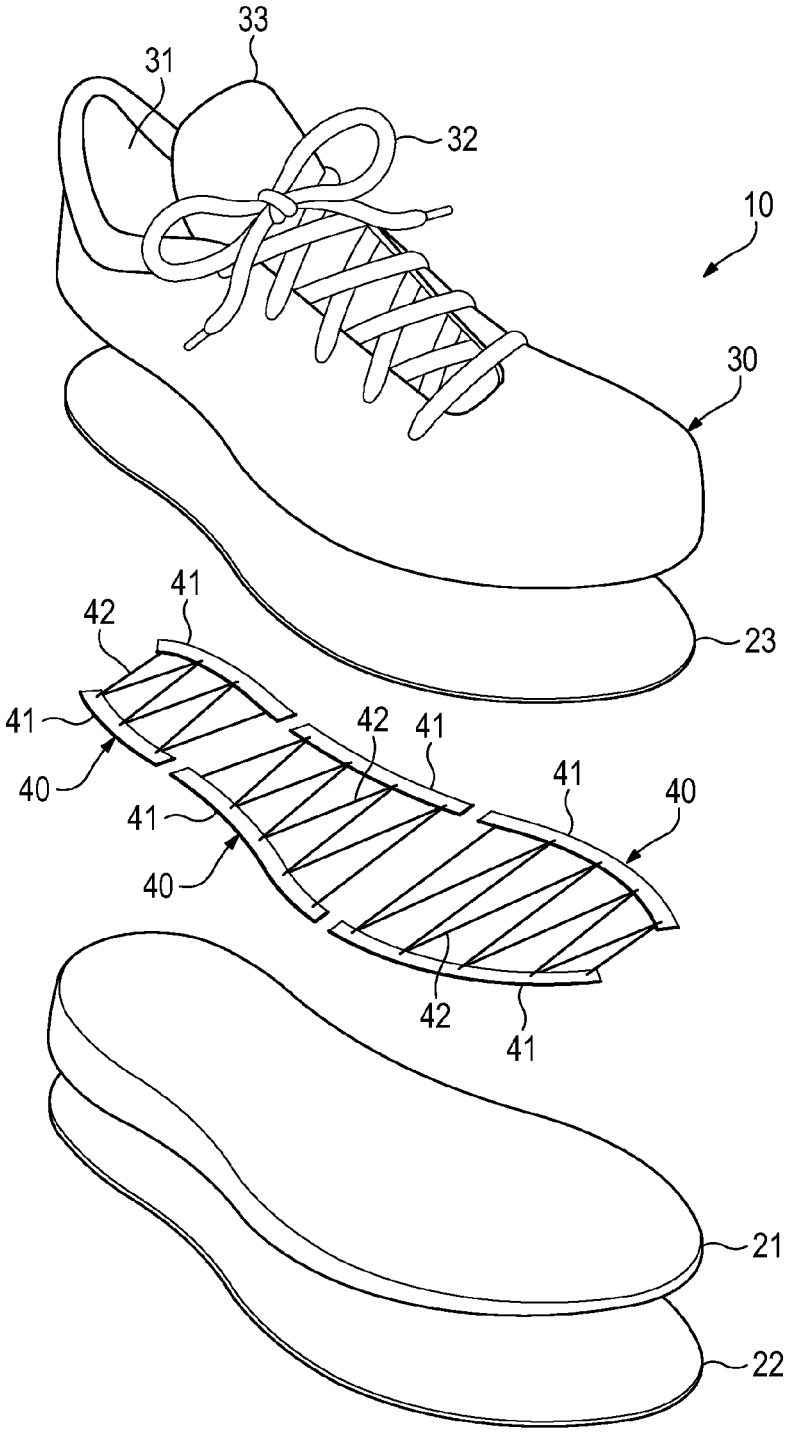
Figure 11C:
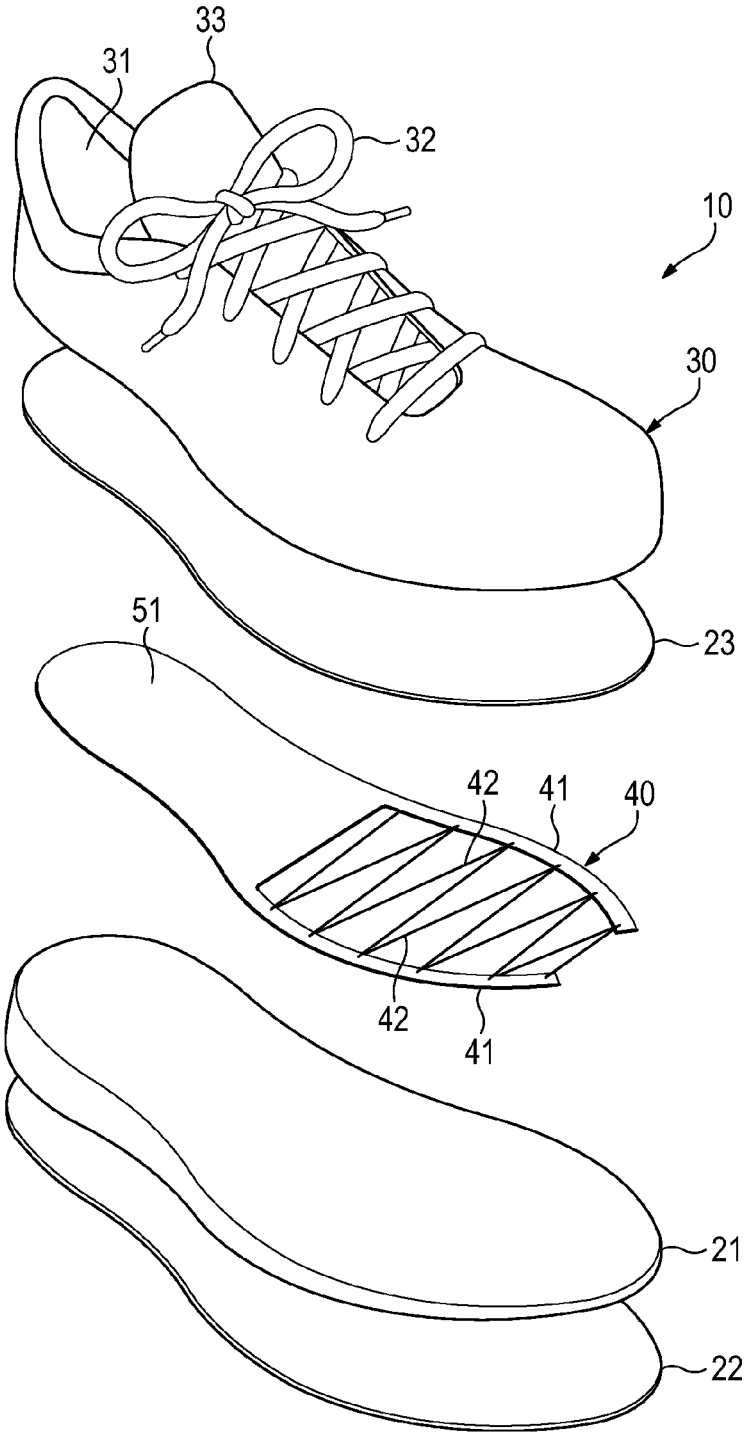

Aspects of footwear 10, including lasting element 40, and the manufacturing process for footwear may vary. Referring to FIG. 2, for example, lasting element 40 has a configuration wherein end areas of strips 41 are unjoined and spaced from each other. As an alternative, FIG. 11A depicts a configuration wherein the end areas are joined. The configuration of FIG. 2 also depicts lasting element 40 as being a single component that extends through substantially all of a length of footwear 10. In some configurations, however, separate lasting elements 40 may be located in different areas of footwear 10. For example, FIG. 11B depicts a configuration wherein three separate lasting elements 40 are located in each of regions 11-13. One advantage of utilizing lasting element 40 is the removal of a strobel sock from the manufacturing process and resulting footwear. Although lasting element 40 effectively replaces a strobel sock, some manufacturing processes may utilize a similar structure in at least a portion of footwear 10. Referring to FIG. 11C, for example, lasting element 40 is located in forefoot region 11, but a strobel sock 51 extends through regions 12 and 13.

Figure 5A:
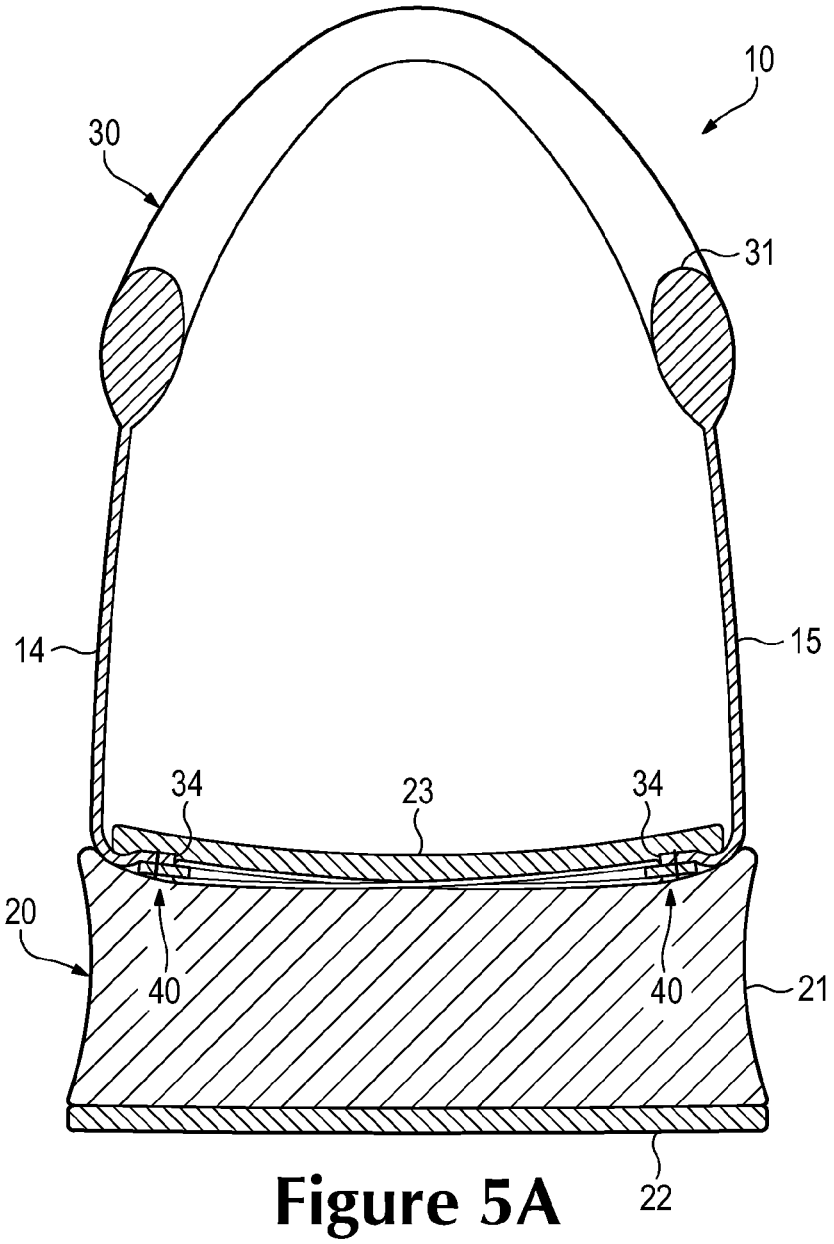
FIGS. 5A and 5B are cross-sectional views of the article of footwear, as respectively defined by section lines 5A and 5B in FIGS. 3 and 4.
Figure 5B:
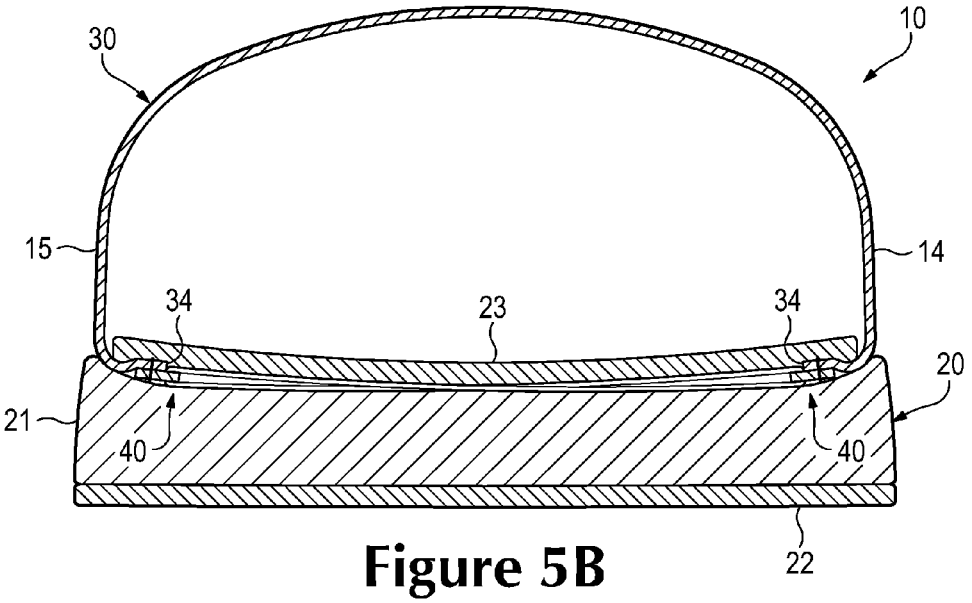
Figure 12A:
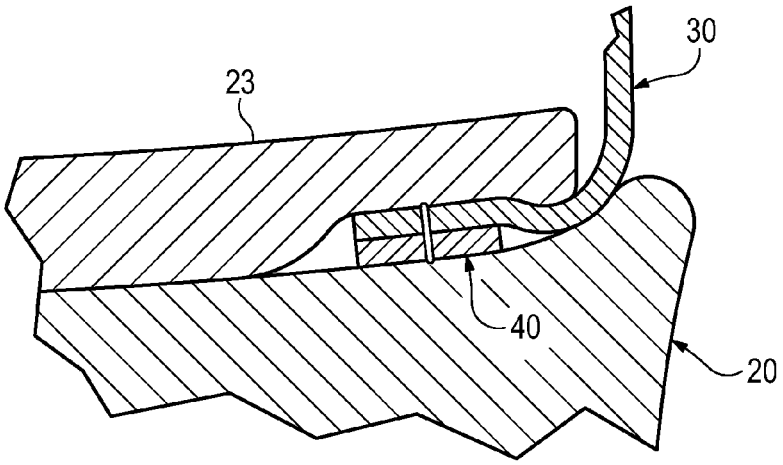
FIGS. 12A-12C are cross-sectional views corresponding with FIG. 5A and depicting further configurations of the article of footwear.
Figure 12B:
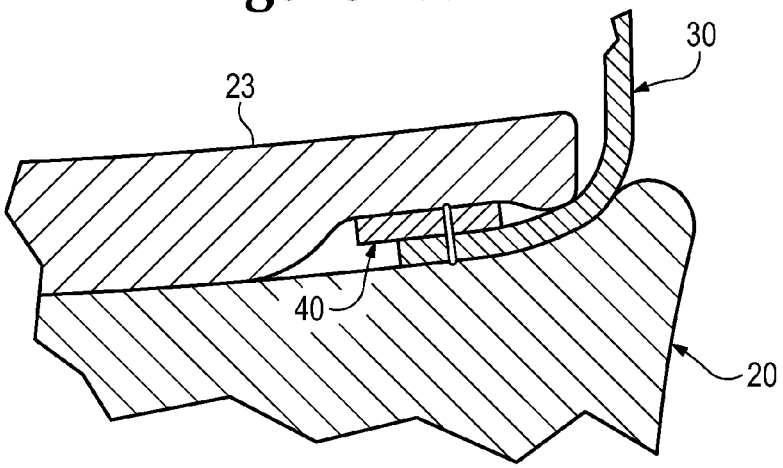
Figure 12C:
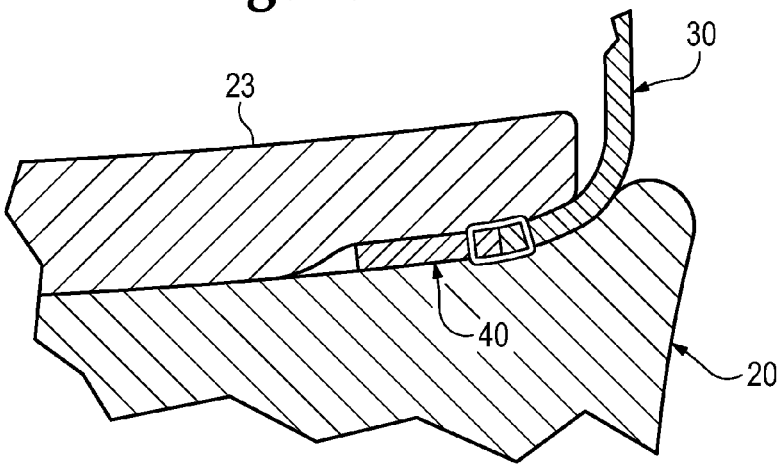

Referring to FIG. 5A, as well as FIGS. 10D and 10E, strips 41 are depicted as overlapping perimeter edge 34 such that (a) a portion of each of strips 41 lays against a surface of upper 30 and (b) another portion of each of strips 41 extends outward from perimeter edge 34. The placement of lasting element 40 with respect to perimeter edge 34 may vary. In further configurations, strips 41 may be secured to upper 30 such that (a) substantially all of strips 41 lay against the surface of upper 30, as depicted in FIG. 12A, (b) strips 41 lay adjacent to an opposite surface of upper 30, as depicted in FIG. 12B, and (c) edges of strips 41 are joined to perimeter edge 34, as depicted in FIG. 12C. Note also that no strand 42 is depicted in FIGS. 12A-12C, such that strand 42 may be removed in latter stages of the manufacturing process. Accordingly, the manner in which strips 41 are joined to upper 30 may vary.

Figure 13A:
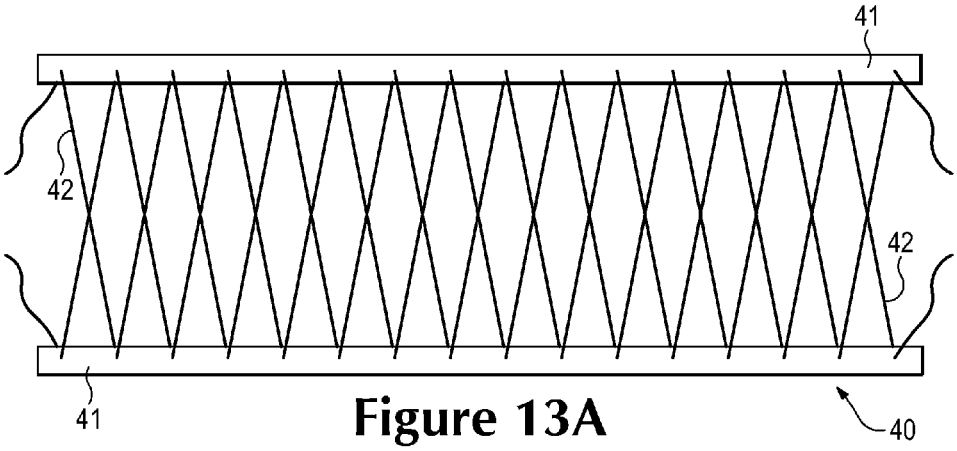
FIGS. 13A-13C are plan views corresponding with FIG. 7 and depicting further configurations of the lasting element.
Figure 13B:
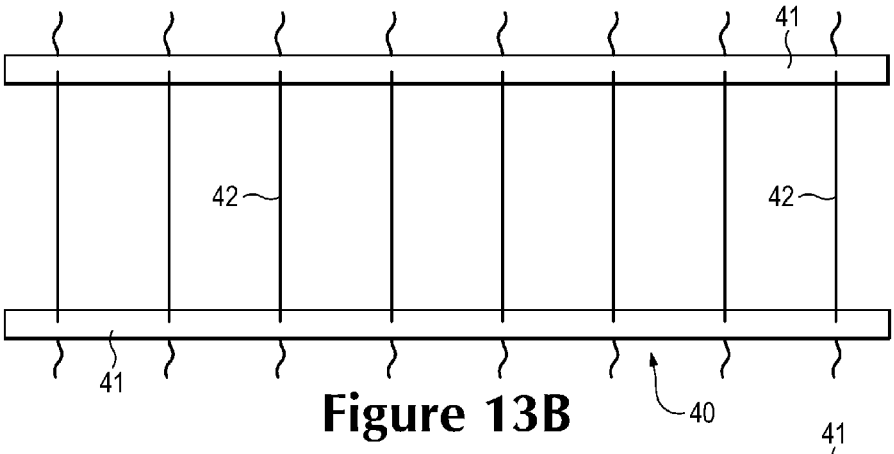
Figure 13C:
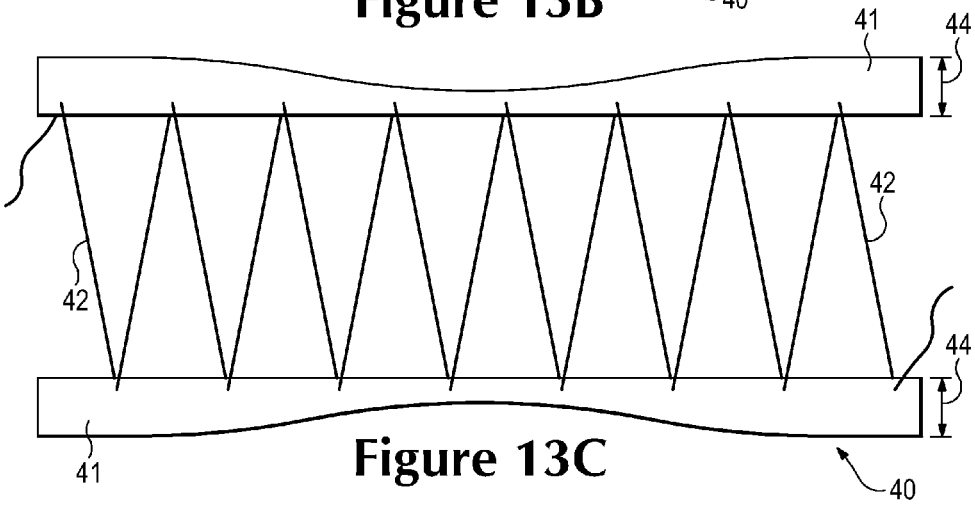

Numerous aspects relating to lasting element 40 may also vary. Referring to FIG. 13A, for example, two strands 42 pass through each of strips 41 and cross each other between strips 41. As another example, a plurality of strands 42 may be located along the lengths of strips 41, as depicted in FIG. 13B. An advantage to this configuration is that strands 42 are independently tensionable during the manufacturing process. In addition to variations associated with strand 42, strips 41 may also vary from the configuration discussed above. As an example, FIG. 13C depicts a configuration wherein width 44 varies along the lengths of strips 41. More particularly, width 44 is relatively small in central areas and of strips 41 and expands in the end areas. Accordingly, the features and configurations of lasting element 40 may vary.

Knitted Component

Figure 14:
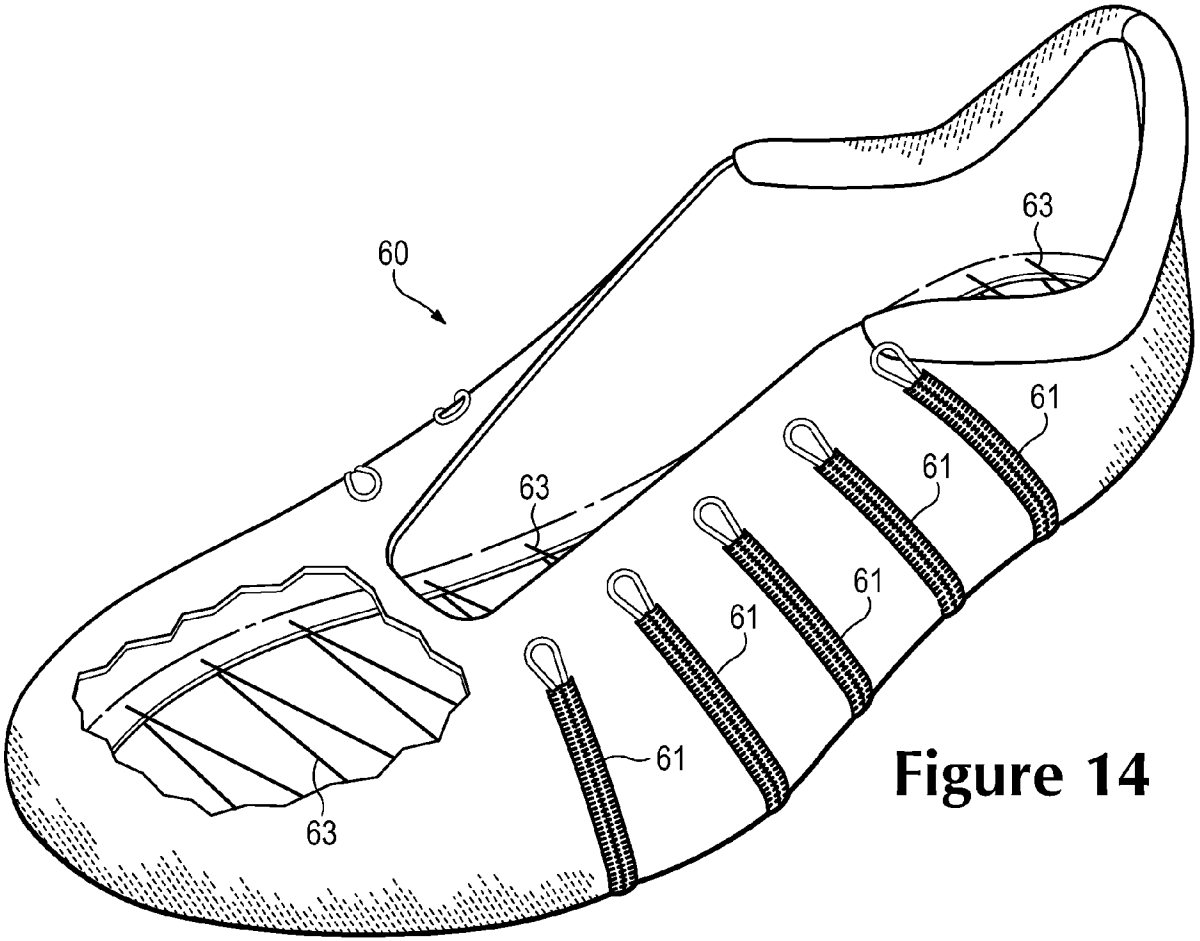
FIG. 14 is a perspective view of a knitted component.

A knitted component 60 is depicted in FIG. 14 and may form a majority of upper 30 or another upper. When incorporated into upper 30, knitted component 60 extends through each of regions 11-13, along both lateral side 14 and medial side 15, over forefoot region 11, and around heel region 13. In addition, knitted component 60 may form both an interior surface and an opposite exterior surface of upper 30. As such, knitted component 60 defines at least a portion of the void within upper 30.

Knitted component 60 includes various tubes 61 in which lace strands 62 are located. As such, knitted component 60 has a configuration that is similar to a knitted component disclosed in U.S. patent application Ser. No. 12/338,726, which was filed in the U.S. Patent and Trademark Office on 18 Dec. 2008 and entitled Article of Footwear Having An Upper Incorporating A Knitted Component, such application being incorporated herein by reference. Additionally, knitted component 60 includes a strand 63 that alternately passes through opposite sides or lower perimeter edges of knitted component 60 to form a w-shaped configuration between the sides or lower perimeter edges. In this way, a portion of strand 63 forms the w-shaped configuration between the sides or lower perimeter edges of component 60, which may also be described as forming a zigzag or wave-like configuration.

During the manufacturing of footwear 10 or another article of footwear that incorporates knitted component 60, strand 63 may be tensioned to draw surfaces of knitted component 60 against a last. As with strand 42, therefore, strand 63 may be utilized to induce knitted component 60 to take on the shape of last 50 during the lasting of footwear 10. That is, tensioning strand 63 induces the void within knitted component 60 to take on the shape of a foot. Given that strand 63 extends through the sides or lower perimeter edges of knitted component 60 and is able to move or slide through the sides or lower perimeter edges, tensioning strand 63 also has the effect of drawing the sides or lower perimeter edges closer to each other along substantially all of a length of knitted component 60. In general, therefore, tensioning strand 63 has the effect of (a) tightening knitted component 60 around a last and (b) drawing the sides or lower perimeter edges of knitted component 60 closer to each other. Once tensioned, a sole structure may be secured to knitted component 60, and strand 63 may be removed from knitted component 60.

A variety of manufacturing processes may be utilized to form knitted component 60, including a flat knitting process that imparts a unitary knit construction. When formed through a flat knitting process, knitted component 60 is formed to include tubes 61, lace strands 62, and strand 63 in a single operation, generally performed by a flat knitting machine, although hand knitting is also possible. An advantage to utilizing a flat knitting process to manufacture knitted component 60 is that various features may be imparted to knitted component 60 through the flat knitting process. That is, a flat knitting process may form knitted component 60 to have, for example, (a) various knit types that impart different properties to separate areas of knitted component 60, (b) various yarn types that impart different properties to separate areas of knitted component 60, (c) overlapping knitted layers that form tubes 61, (d) a material such as strands 62 that are laid into tubes 61, and (e) strand 63 that alternately passes through opposite sides or lower perimeter edges of knitted component 60. As such, a flat knitting process may be utilized to substantially form knitted component 60 to have various properties and structural features that are advantageous to footwear 10.

The invention is disclosed above and in the accompanying figures with reference to a variety of configurations. The purpose served by the disclosure, however, is to provide an example of the various features and concepts related to the invention, not to limit the scope of the invention. One skilled in the relevant art will recognize that numerous variations and modifications may be made to the configurations described above without departing from the scope of the present invention, as defined by the appended claims.

The invention claimed is:

1. A method of manufacturing an article of footwear, the method comprising:

assembling at least a portion of an upper of the article of footwear, the upper having a lower perimeter edge;

providing a strobel sock having an integral lasting element extending through a portion of the strobel sock, the strobel sock and lasting element having been previously formed separately from the upper, the lasting element comprising: (a) a first strip, (b) a second strip spaced apart from the first strip, and (c) at least one strand extending through the first strip and the second strip;

securing the strobel sock and lasting element to the upper, wherein securing the lasting element further comprises: (a) joining the first strip to a lateral side of the upper adjacent to the lower perimeter edge, (b) joining the second strip to a medial side of the upper adjacent to the lower perimeter edge, and (c) wherein the at least one strand is disposed through the first strip and the second strip so as to extend between the lateral side of the upper and the medial side of the upper;

tensioning the at least one strand; and joining a sole structure of the article of footwear to the upper.

2. The method recited in claim 1, wherein the strobel sock extends through at least a portion of a heel region and a midfoot region of the upper.

3. The method recited in claim 2, wherein the lasting element extends through a forefoot region of the upper.

4. The method recited in claim 3, wherein the step of tensioning the strand includes drawing the first strip and the second strip closer together at the forefoot region of the upper.

5. The method recited in claim 1, further including a step of forming the strobel sock and the lasting element of unitary knit construction so that the first strip, the second strip, and the at least one strand are a one-piece element with the strobel sock.

6. The method recited in claim 5, wherein the step of forming the strobel sock and the lasting element includes a flat-knitting process.

7. The method recited in claim 1, further including a step of removing the strand from the lasting element after the step of joining an outsole associated with the sole structure to the upper.

* * * * *